US009879676B2

(12) United States Patent
Moroe et al.

(10) Patent No.: US 9,879,676 B2
(45) Date of Patent: Jan. 30, 2018

(54) MULTI-CYLINDER ROTARY COMPRESSOR AND VAPOR COMPRESSION REFRIGERATION CYCLE SYSTEM INCLUDING THE MULTI-CYLINDER ROTARY COMPRESSOR

(71) Applicant: MITSUBISHI ELECTRIC CORPORATION, Chiyoda-ku (JP)

(72) Inventors: Shogo Moroe, Chiyoda-ku (JP); Tetsuhide Yokoyama, Chiyoda-ku (JP); Toshiaki Iwasaki, Chiyoda-ku (JP); Taro Kato, Chiyoda-ku (JP); Hideaki Maeyama, Chiyoda-ku (JP); Shinichi Takahashi, Chiyoda-ku (JP); Kanichiro Sugiura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 120 days.

(21) Appl. No.: 14/783,952

(22) PCT Filed: Apr. 25, 2014

(86) PCT No.: PCT/JP2014/061713
§ 371 (c)(1),
(2) Date: Oct. 12, 2015

(87) PCT Pub. No.: WO2014/175429
PCT Pub. Date: Oct. 30, 2014

(65) Prior Publication Data

US 2016/0047379 A1 Feb. 18, 2016

(30) Foreign Application Priority Data

Apr. 26, 2013 (JP) ..... 2013-094151

(51) Int. Cl.
*F25D 21/06* (2006.01)
*F25B 7/00* (2006.01)
(Continued)

(52) U.S. Cl.
CPC ..... *F04C 23/001* (2013.01); *F01C 21/0845* (2013.01); *F01C 21/0863* (2013.01);
(Continued)

(58) Field of Classification Search
CPC .. F04C 28/06; F04C 18/3564; F04C 18/3568; F04C 23/001; F04C 23/008; F01C 21/0845; F01C 21/0863
(Continued)

(56) References Cited

FOREIGN PATENT DOCUMENTS

CN 1950612 A 4/2007
EP 2 428 641 A2 3/2012
(Continued)

OTHER PUBLICATIONS

Combined Chinese Office Action and Search Report dated Aug. 15, 2016 in Patent Application No. 201480023073.0 (with English translation and English translation of categories of cited documents).
(Continued)

*Primary Examiner* — Mark Laurenzi
*Assistant Examiner* — Anthony Ayala Delgado
(74) *Attorney, Agent, or Firm* — Oblon, McClelland, Maier & Neustadt, L.L.P.

(57) ABSTRACT

A multi-cylinder rotary compressor includes plural compression mechanism parts. A drawing force is applied to a vane of at least one of the compression mechanism parts radially outward with respect to a drive shaft, making a pressing force pressing the vane toward a piston smaller than in other compression mechanism parts. In a normal state, a pressing force due to a gas pressure difference between a suction
(Continued)

pressure and a discharge pressure is larger than the drawing force, and a vane front end is pressed against a rotary piston peripheral wall. When the drawing force becomes greater than the pressing force, the vane front end is moved to separate from the rotary piston peripheral wall with a space through which oil is introduced from a sealed container, and a retention mechanism retains the vane separated from the piston, and the compression mechanism part switches to an uncompressed state.

10 Claims, 24 Drawing Sheets

(51) Int. Cl.

| | |
|---|---|
| ***F25B 41/00*** | (2006.01) |
| ***F04C 23/00*** | (2006.01) |
| ***F01C 21/08*** | (2006.01) |
| ***F04C 28/06*** | (2006.01) |
| ***F04C 18/356*** | (2006.01) |
| ***F04C 29/00*** | (2006.01) |
| ***F04C 29/02*** | (2006.01) |
| ***F25B 31/02*** | (2006.01) |

(52) U.S. Cl.
CPC ..... *F04C 18/3564* (2013.01); *F04C 18/3568* (2013.01); *F04C 23/008* (2013.01); *F04C 28/06* (2013.01); *F04C 29/0085* (2013.01); *F04C 29/02* (2013.01); *F25B 31/026* (2013.01)

(58) Field of Classification Search
USPC ..... 418/23
See application file for complete search history.

(56) References Cited

FOREIGN PATENT DOCUMENTS

| | | | |
|---|---|---|---|
| JP | 61-159691 | A | 7/1986 |
| JP | 2005-171848 | A | 6/2005 |
| JP | 2007-64110 | A | 3/2007 |
| JP | 2008-128231 | A | 6/2008 |
| JP | 2010-163926 | A | 7/2010 |
| JP | 4594301 | B2 | 12/2010 |
| JP | 2011-127475 | A | 6/2011 |

OTHER PUBLICATIONS

Extended European Search Report dated Nov. 7, 2016 in patent application No. 14788378.9.
Office Action dated Sep. 27, 2016 in Japanese Patent Application No. 2015-513852 (with English language translation).
International Search Report dated Jul. 15, 2014 for PCT/JP2014/061713 filed on Apr. 25, 2014.
European Patent Office Communication pursuant to Article 94(3) EPC issued in European Application No. 14788378.9 dated Sep. 22, 2017.

(a)

(b)

(a)

PRESSING BIAS $F - (Pd - Ps) A < 0$

SEPARATION OF VANE $F - (Pd - Ps) A > 0$ (b)

CYLINDER CUTOFF RETENTION $F + \Delta F - (Pd - Ps) A > 0$

CANCEL RETENTION $F + \Delta F - (Pd - Ps) A < 0$ (a)

(b)

(a)

(b)

(a)

(b)

(a)

(b)

(a)

(b)

(a)

(b)

(a)

(b)

MULTI-CYLINDER ROTARY COMPRESSOR AND VAPOR COMPRESSION REFRIGERATION CYCLE SYSTEM INCLUDING THE MULTI-CYLINDER ROTARY COMPRESSOR

TECHNICAL FIELD

The present invention relates to a multi-cylinder rotary compressor for use in heat pump equipment and a vapor compression refrigeration cycle system including the multi-cylinder rotary compressor, and more particularly to a multi-cylinder rotary compressor with improved energy saving performance under an operating condition close to an actual load and a vapor compression refrigeration cycle system including the multi-cylinder rotary compressor.

BACKGROUND ART

Conventional heat pump equipment such as an air-conditioning apparatus and a water heater typically uses a vapor compression refrigeration cycle system using a multi-cylinder rotary compressor. Specifically, such heat pump equipment incorporates a refrigeration cycle formed by connecting a multi-cylinder rotary compressor, a condensor, a pressure reducing unit, and an evaporator by pipes to perform an operation in accordance with an application (e.g., air-conditioning or hot water supply).

In recent years, regulations for energy conservation of air-conditioning apparatus have been tightened in many countries, and the operation standard has been changed to that close to an actual load. In Japan, a conventional indication of efficiency improvement based on an average COP in cooling and heating was changed to an indication based on an annual performance factor (APF) on 2011. Energy conservation standards of air-conditioning apparatus and water heaters are expected to be changed to a new standard closer to an actual load. For example, the rated heating capacity necessary for starting an air-conditioning apparatus is assumed to be 100%, an always necessary heating capacity is about 10% to 50%, and efficiencies in this low-load region has a greater influence on an actual APF than the rated capacity.

For this reason, an on-off control has been employed for a long time as a unit for adjusting a cooling and heating capacity. This on-off control, however, has problems such as increased temperature control range, increased vibration noise, and a degraded energy saving performance. Consequently, to improve energy saving performance, for example, an inverter control that changes a rotation speed of an electric motor for driving a multi-cylinder rotary compressor has been widely employed in recent years.

Recent air-conditioning apparatus have been required to have a reduced start-up time and operate under severe environments (under low or high temperatures), and thus, a rated capacity to a certain level or higher has been needed. On the other hand, an always necessary capacity is small for heat-insulated houses that have currently been popular, and the capacity range in operation has increased. Consequently, the variable range of the rotation speed of the multi-cylinder rotary compressor by the inverter increases, and the rotation speed range where a high efficiency of the multi-cylinder rotary compressor is required tends to increase. Thus, it has become difficult for a conventional air-conditioning apparatus to continuously operate a multi-cylinder rotary compressor at a reduced rotation speed and maintain a high efficiency of the multi-cylinder rotary compressor under low-load capacity conditions.

In this situation, a multi-cylinder rotary compressor using a unit (mechanical capacity controlling unit) for mechanically changing an air volume attracts attention again. For example, Patent Literature 1 proposes a reciprocating multi-cylinder rotary compressor in which "a second compression mechanism part 2B in a multi-cylinder rotary compressor A includes a cylinder cutoff mechanism K for separating a tip edge of a second blade 15b from a peripheral surface of a roller 13b to attain suspension of compression operation in a second cylinder chamber 14b, and the cylinder cutoff mechanism includes a blade back chamber 16b housing a rear end of the blade and forming a closed space, a discharge pressure introducing passage 20 for introducing a discharge pressure to the blade back chamber 16b, a shut-off valve 21 for opening and closing communication of the discharge pressure introducing passage 20, and a biasing holder 18 that biases and holds the blade tip edge in a direction away from the roller peripheral surface." In the multi-cylinder rotary compressor described in Patent Literature 1, the shut-off valve 21 is closed under a low load so that the blade back chamber 16b becomes a closed space, and thereby, a pressure difference between a front surface and a rear surface of the blade 15b (vane) is eliminated. The blade 15b (vane) is moved back by a piston and is attracted by a magnet provided in the blade back chamber 16b so that the blade 15b (vane) is separated from the piston. That is, in the multi-cylinder rotary compressor of Patent Literature 1, one compression mechanism part is set in an uncompressed state to reduce the flow rate of circulating refrigerant by half so that the compressor can operate without a reduction in the rotation speed of an electric motor, thereby achieving an increased compressor efficiency.

To reduce a load in start-up of a multi-cylinder rotary compressor, Patent Literature 2 proposes a "multi-cylinder rotary compressor which includes a hermetically sealed container having a high internal pressure and housing an electric element and a plurality of rotary compressor elements driven by the electric element, and in which a spring is provided at the back of a vane of at least one of the rotary compressor elements and draws the vane outward and a spring is provided at the back of a vane of another rotary compressor element and presses the vane inward." That is, in the multi-cylinder rotary compressor of Patent Literature 2, the front end of a vane is separated from the outer peripheral wall of a piston when a pressure difference does not occur between the front surface and the rear surface of the vane, and when a pressure occurs between the front surface and the rear surface of the vane, the front end of the vane is pressed against the piston.

CITATION LIST

Patent Literatures

Patent Literature 1: Japanese Unexamined Patent Application Publication No. 2010-163926 (Abstract, FIGS. 1 and 2)

Patent Literature 2: Japanese Unexamined Utility Model Application Publication No. 61-159691 (Claim, FIG. 1)

SUMMARY OF INVENTION

Technical Problem

The multi-cylinder rotary compressor of Patent Literature 1 uses a mechanical capacity controlling unit of a cylinder cutoff operation type to suppress a decrease in efficiency under a low-load condition. That is, the multi-cylinder rotary compressor of Patent Literature 1 needs a mechanical capacity controlling unit including, for example, a shut-off valve, a switching valve, and a pipe to switch a pressure applied to a rear end of a vane. Thus, the multi-cylinder rotary compressor of Patent Literature 1 has problems of increased size and costs of the multi-cylinder rotary compressor.

Since the multi-cylinder rotary compressor of Patent Literature 2 does not include a mechanism for holding a vane when the front end of the vane is separated from the outer peripheral wall of the piston, the pressure difference between the front surface and the rear surface of the vane fluctuates so that the vane reciprocates in a vane groove. Thus, in the multi-cylinder rotary compressor of Patent Literature 2, the location of the vane is unstable, and thus, repetitive contact between the vane front end and the piston increases noise.

The present invention has been made to solve problems as described above, and provides a multi-cylinder rotary compressor that can prevent increases in size and costs and can keep the location of a vane stable when the front end of a vane is separated from an outer peripheral wall of a piston, and a vapor compression refrigeration cycle system including the multi-cylinder rotary compressor.

Solution to Problems

The present invention provides a multi-cylinder rotary compressor including a drive shaft including a plurality of eccentric-pin shaft portions, an electric motor configured to drive and rotate the drive shaft, a plurality of compression mechanisms, and a sealed container housing the electric motor and the plurality of compression mechanisms and storing lubricating oil at a bottom thereof. Each of the plurality of compression mechanisms includes a cylinder having a cylinder chamber into which low-pressure refrigerant is sucked from a suction pressure space and from which compressed high-pressure refrigerant is discharged to a discharge pressure space, a ring-shaped piston slidably attached to each of the plurality of eccentric-pin shaft portions of the drive shaft and configured to eccentrically rotate in the cylinder chamber, a vane configured to separate the cylinder chamber into two spaces when a front end of the vane is pushed against an outer peripheral surface of the piston, a vane groove housing the vane in such a manner that the vane reciprocates therein and being open to the cylinder chamber, and a vane rear chamber housing a rear end of the vane and communicating with the cylinder chamber. The cylinder chamber always communicates with the suction pressure space, and the vane rear chamber always communicates with the discharge pressure space. In a driven state, each of the vanes is applied by a first force in such a direction that the vane approaches the piston caused by a pressure difference between a pressure applied to the front end of each of the vanes and a pressure applied to the rear end of each of the vanes. The plurality of compression mechanisms includes a second compression mechanism part having a mechanism that includes a permanent magnet disposed in the vane rear chamber and applies a second force to the vane in such a direction that the vane moves away from the piston and, thereby, applies the first force and the second force to the vane, and switches between a compressed state in which the vane is in contact with the piston and an uncompressed state in which the vane is separated from the piston and attracted by the permanent magnet and retained thereon, depending on a magnitude correlation between the first force and the second force, and a configuration in which the pressure difference in switching from the uncompressed state to the compressed state is larger than the pressure difference in switching from the compressed state to the uncompressed state, by utilizing a property of the permanent magnet that the second force is larger in the uncompressed state in which the front end of the vane is attracted and retained on the permanent magnet than in a state in which the front end of the vane is in contact with the piston.

Advantageous Effects of Invention

In the multi-cylinder rotary compressor according to the present invention, a pressing force of pressing the vane against the piston in the second compression mechanism part is smaller than that in a first compression mechanism part, which is another compression mechanism part except the second compression mechanism part. In other words, the second compression mechanism part has a configuration having a larger drawing force applied to the vane in such a direction that the vane moves away from the piston (moves toward the rear end) than that in the first compression mechanism part. Thus, when the pressure applied to the rear end decreases below a predetermined value, the vane of the second compression mechanism part comes to be separated from the piston, and the second compression mechanism part switches to a cylinder cutoff state. As a result, the multi-cylinder rotary compressor according to the present invention can operate without a reduction in the rotation number of the electric motor and, thus, enhance the compression efficiency by switching the second compression mechanism part to the uncompressed state to reduce the refrigerant circulation flow rate by half. At this time, the multi-cylinder rotary compressor according to the present invention does not require a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor can be prevented.

In addition, the second compression mechanism part of the multi-cylinder rotary compressor according to the present invention includes the mechanism that comes into contact with the vane and retains the vane when the vane moves to be separated from the piston. Thus, the multi-cylinder rotary compressor according to the present invention can stably retain the location of the vane when the front end of the vane is separated from the outer peripheral wall of the piston.

DESCRIPTION OF EMBODIMENTS

Examples of a multi-cylinder rotary compressor according to the present invention will be described with reference to the drawings. In the attached drawings, the size relationship among components may differ from those in actual application. Three-dimensional relationships between discharge ports 18 and 28 and the cylinder suction channels 17 and 27 do not necessarily coincide with each other between a longitudinal sectional view and a transverse sectional view.

Embodiment 1

[Configuration of Multi-cylinder Rotary Compressor 100]

Figure 1:
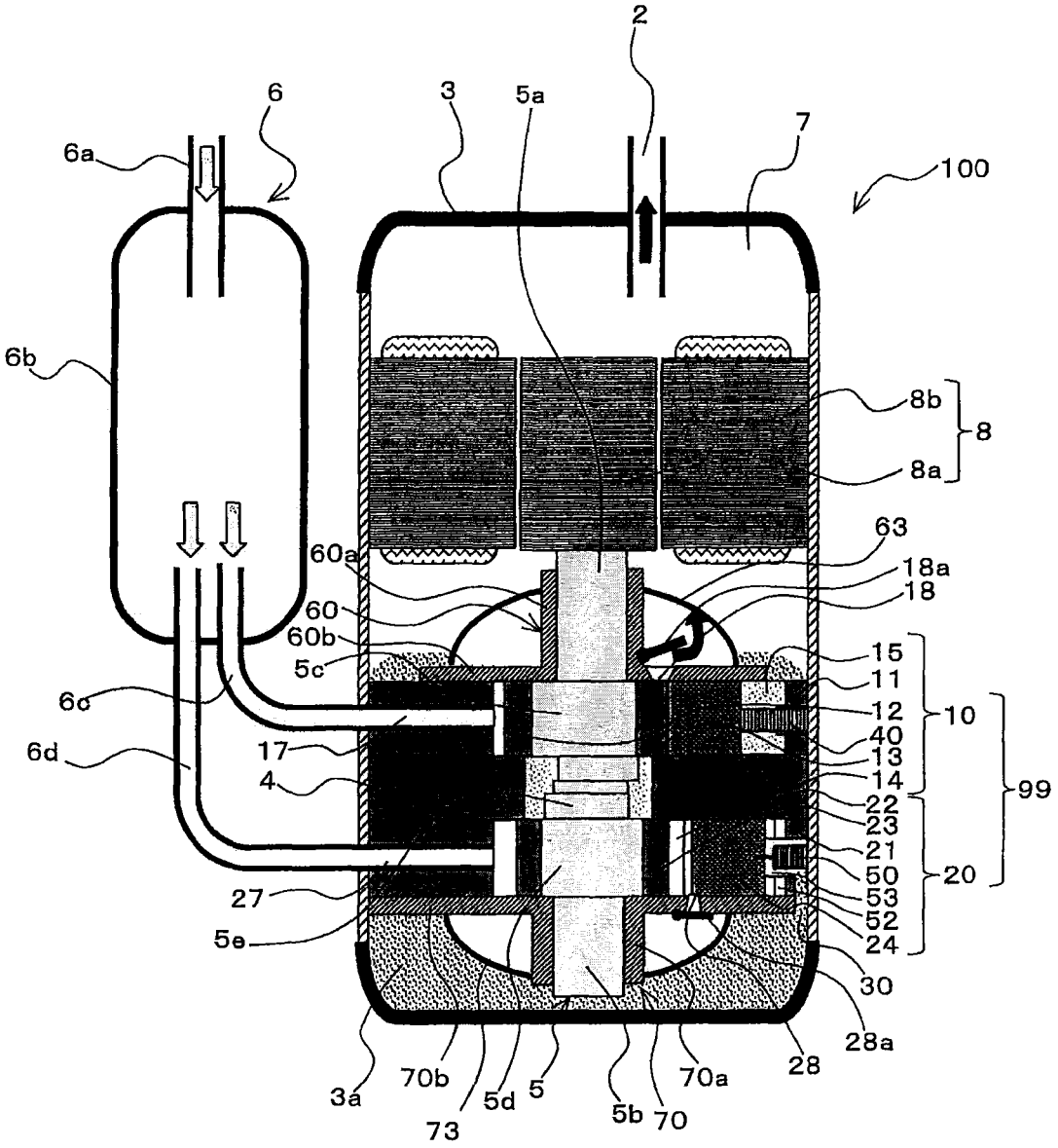
FIG. 1 is a longitudinal sectional view schematically illustrating a configuration of a multi-cylinder rotary compressor 100 according to Embodiment 1 of the present invention.
Figure 2:
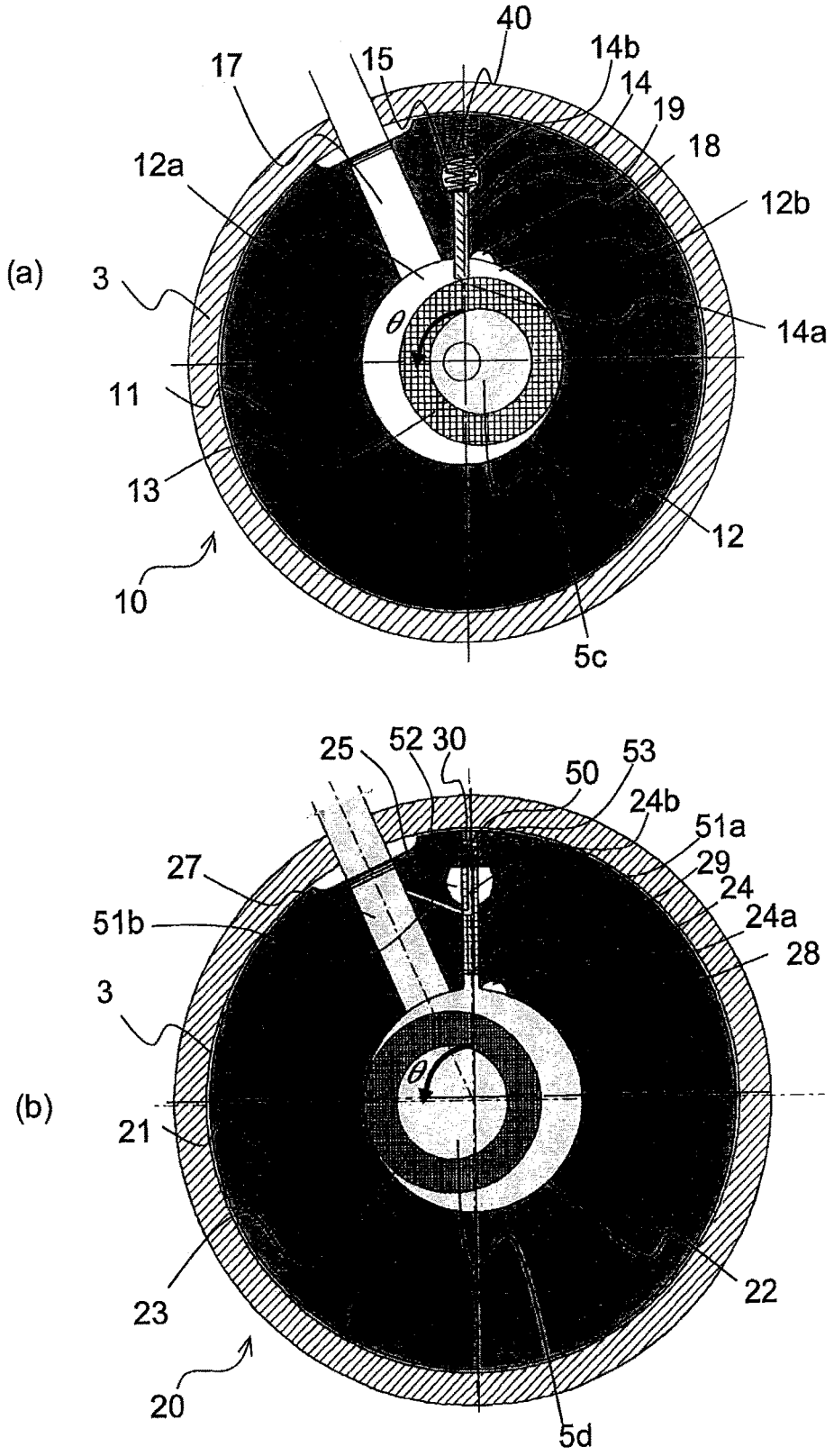
FIG. 2 shows transverse sectional views schematically illustrating the configuration of the multi-cylinder rotary compressor 100 according to Embodiment 1 of the present invention, where (a) is a schematic transverse sectional view of a first compression mechanism part 10 and (b) is a schematic transverse sectional view of a second compression mechanism part 20.

FIG. 1 is a longitudinal sectional view schematically illustrating a configuration of a multi-cylinder rotary compressor 100 according to Embodiment 1 of the present invention. FIG. 2 shows schematic transverse sectional views schematically illustrating the configuration of the multi-cylinder rotary compressor 100 according to Embodiment 1 of the present invention, where (a) is a schematic transverse sectional view of a first compression mechanism part 10 and (b) is a schematic transverse sectional view of a second compression mechanism part 20. In the multi-cylinder rotary compressor 100 illustrated in FIGS. 1 and 2, the first compression mechanism part 10 is in a compressed state and the second compression mechanism part 20 is an uncompressed state (cylinder cutoff state).

The multi-cylinder rotary compressor 100 is a component included in a refrigeration cycle employed in heat pump equipment such as an air-conditioning apparatus or a water heater. The multi-cylinder rotary compressor 100 sucks gaseous fluid, compresses the fluid into a high-temperature high-pressure state to discharge the resulting high-temperature high-pressure fluid.

The multi-cylinder rotary compressor 100 of Embodiment 1 includes, in an internal space 7 of a sealed container 3, a compression mechanism 99 constituted by the first compression mechanism part 10 and the second compression mechanism part 20, and an electric motor 8 configured to drive the first compression mechanism part 10 and the second compression mechanism part 20 through a drive shaft 5.

The sealed container 3 is, for example, a cylindrical sealed container whose upper and lower ends are closed. A lubricating oil storage unit 3*a* for storing lubricating oil for lubricating the compression mechanism 99 is provided at the bottom of the sealed container 3. A compressor discharge pipe 2 is provided at the top of the sealed container 3 and communicates with the internal space 7 of the sealed container 3.

The electric motor 8 operates, for example, at a variable rotation speed that can be changed by inverter control or the like, and includes a stator 8*b* and a rotor 8*a*. The stator 8*b* has a substantially cylindrical shape, and has an outer periphery thereof fixed to the sealed container 3 by, for example, shrinkage fitting. A coil to which electric power is supplied from an external power supply is wound around the stator 8*b*. The rotor 8*a* has a substantially cylindrical shape and disposed to an inner peripheral portion of the stator 8*b* at a predetermined distance from an inner peripheral surface of the stator 8*b*. The drive shaft 5 is fixed to the rotor 8*a*, and the electric motor 8 and the compression mechanism 99 are connected to each other through the drive shaft 5. That is, when the electric motor 8 rotates, a torque is transmitted to the compression mechanism 99 through the drive shaft 5.

The drive shaft 5 includes a longer shaft portion 5*a* constituting an upper portion of the drive shaft 5, a shorter shaft portion 5*b* constituting a lower portion of the drive shaft, an eccentric-pin shaft portions 5*c* and 5*d*, and an intermediate shaft portion 5*e*. The eccentric-pin shaft portions 5*c* and 5*d* and an intermediate shaft portion 5*e* are disposed between the longer shaft portion 5*a* and the shorter shaft portion 5*b*. The central axis of the eccentric-pin shaft portion 5*c* is eccentric away from the central axes of the longer shaft portion 5*a* and the shorter shaft portion 5*b* at a predetermined distance, and the eccentric-pin shaft portion 5*c* is disposed in a first cylinder chamber 12 of the first compression mechanism part 10 described later. The central axis of the eccentric-pin shaft portion 5*d* is eccentric away from the central axes of the longer shaft portion 5*a* and the shorter shaft portion 5*b* at a predetermined distance, and the eccentric-pin shaft portion 5*d* is disposed in a second cylinder chamber 22 of the second compression mechanism part 20 described later. The phases of the eccentric-pin shaft portion 5*c* and the eccentric-pin shaft portion 5*d* shift from each other by 180 degrees. The eccentric-pin shaft portion 5*c* and the eccentric-pin shaft portion 5*d* are connected to each other by the intermediate shaft portion 5*e*. The intermediate shaft portion 5*e* is disposed in a through hole in an intermediate partition plate 4 described later. The longer shaft portion 5*a* of the thus-configured drive shaft 5 is rotatably supported on a bearing portion 60*a* of a first support member 60, and the shorter shaft portion 5*b* of the thus-configured drive shaft 5 is rotatably supported on a bearing portion 70*a* of a second support member 70.

That is, the eccentric-pin shaft portions 5*c* and 5*d* of the drive shaft 5 eccentrically rotate in the first cylinder chamber 12 and the second cylinder chamber 22.

The compression mechanism 99 is constituted by the upper rotary first compression mechanism part 10 and the lower rotary second compression mechanism part 20, and the first compression mechanism part 10 and the second compression mechanism part 20 are disposed below the electric motor 8. The compression mechanism 99 includes the first support member 60, a first cylinder 11 constituting the first compression mechanism part 10, the intermediate partition plate 4, a second cylinder 21 constituting the second compression mechanism part 20, and the second support member 70, which are sequentially laminated in this order from the top to the bottom.

The first compression mechanism part 10 includes, for example, the first cylinder 11, a first piston 13, and a first vane 14. The first cylinder 11 is a flat plate member having a substantially cylindrical through hole that vertically penetrates the flat plate member and is substantially concentric with the drive shaft 5 (more specifically, the longer shaft portion 5*a* and the shorter shaft portion 5*b*). The through hole has one end (upper end in FIG. 1) closed with a flange portion 60*b* of the first support member 60 and the other end (lower end in FIG. 1) closed with the intermediate partition plate 4, and serves as the first cylinder chamber 12.

The first piston 13 is disposed in the first cylinder chamber 12 of the first cylinder 11. The first piston 13 has a ring shape and is slidably disposed on the eccentric-pin shaft portion 5*c* of the drive shaft 5. The first cylinder 11 has a vane groove 19 communicating with (open to) the first cylinder chamber 12 and extending in a radial direction of the first cylinder chamber 12. The first vane 14 is slidably disposed in the vane groove 19. In other words, the vane groove 19 houses the first vane 14 in such a manner that the first vane 14 can reciprocate therein. When a front end 14*a* of the first vane 14 comes into contact with an outer peripheral portion of the first piston 13, the first cylinder chamber 12 is partitioned into a suction chamber 12*a* and a compression chamber 12*b*.

The first cylinder 11 includes a vane rear chamber 15 housing a rear end 14*b* of the first vane 14 at the rear of the vane groove 19, that is, at the rear of the first vane 14, and communicating with the first cylinder chamber 12 through the vane groove 19. The vane rear chamber 15 vertically penetrates the first cylinder 11. The upper opening of the vane rear chamber 15 is partially open to the internal space 7 of the sealed container 3 so that lubricating oil stored in the lubricating oil storage unit 3*a* can flow into the vane rear chamber 15. The lubricating oil that has flowed into the vane rear chamber 15 enters a clearance between the vane groove 19 and the first vane 14 and reduces a sliding friction therebetween. As will be described later, in the multi-cylinder rotary compressor 100 according to Embodiment 1, refrigerant compressed in the compression mechanism 99 is discharged to the internal space 7 of the sealed container 3.

Consequently, the vane rear chamber 15 is in a high-pressure atmosphere that is the same as the internal space 7 of the sealed container 3.

The second compression mechanism part 20 includes, for example, the second cylinder 21, a second piston 23, and a second vane 24. The second cylinder 21 is a flat plate member having a substantially cylindrical through hole that vertically penetrates the flat plate member and is substantially concentric with the drive shaft 5 (more specifically, the longer shaft portion 5*a* and the shorter shaft portion 5*b*). The through hole has one end (upper end in FIG. 1) closed with the intermediate partition plate 4 and the other end (lower end in FIG. 1) closed with a flange portion 70*b* of the second support member 70, and serves as the second cylinder chamber 22.

The second piston 23 is disposed in the second cylinder chamber 22 of the second cylinder 21. The second piston 23 has a ring shape and is slidably disposed on the eccentric-pin shaft portion 5*d* of the drive shaft 5. The second cylinder 21 has a vane groove 29 communicating with (open to) the second cylinder chamber 22 and extending in a radial direction of the second cylinder chamber 22. The second vane 24 is slidably disposed in the vane groove 29. In other words, the vane groove 29 houses the second vane 24 in such a manner that the second vane 24 can reciprocate therein. When a front end 24*a* of the second vane 24 comes into contact with an outer peripheral portion of the second piston 23, the second cylinder chamber 22 is partitioned into a suction chamber and a compression chamber in a manner similar to the first cylinder chamber 12.

The second cylinder 21 includes a vane rear chamber 25 housing a rear end 24*b* of the second vane 24 at the rear of the vane groove 29, that is, at the rear of the second vane 24, and communicating with the second cylinder chamber 22 through the vane groove 29. The vane rear chamber 25 vertically penetrates the second cylinder 21. The upper and lower openings of the vane rear chamber 25 are closed with the intermediate partition plate 4 and the flange portion 70*b* of the second support member 70, and the vane rear chamber 25 communicates with the internal space 7 of the sealed container 3 through a channel 30 extending from the outer peripheral surface of the second cylinder 21 to the vane rear chamber 25. That is, lubricating oil stored in the lubricating oil storage unit 3*a* can flow into the vane rear chamber 25 through the channel 30. Consequently, the vane rear chamber 25 is in a high-pressure atmosphere that is the same as the internal space 7 of the sealed container 3. The lubricating oil that has flowed into the vane rear chamber 25 enters a clearance between the vane groove 29 and the second vane 24 and reduces a sliding friction therebetween.

At least one of the openings of the vane rear chamber 25 may be open to the internal space 7 of the sealed container 3 so that the lubricating oil stored in the lubricating oil storage unit 3*a* can flow into the vane rear chamber 25 through this opening.

A suction muffler 6 for allowing gaseous refrigerant to flow into the first cylinder chamber 12 and the second cylinder chamber 22 is connected to the first cylinder 11 and the second cylinder 21. Specifically, the suction muffler 6 includes a container 6*b*, an inlet pipe 6*a* introducing low-pressure refrigerant from an evaporator to the container 6*b*, an outlet pipe 6*c* introducing gaseous refrigerant included in refrigerant stored in the container 6*b* to the first cylinder chamber 12 of the first cylinder 11, and an outlet pipe 6*d* introducing gaseous refrigerant included in the refrigerant stored in the container 6*b* to the second cylinder chamber 22 of the second cylinder 21. The outlet pipe 6*c* of the suction muffler 6 is connected to a cylinder suction channel 17 (channel communicating with the first cylinder chamber 12) of the first cylinder 11. The outlet pipe 6*d* of the suction muffler 6 is connected to a cylinder suction channel 27 (channel communicating with the second cylinder chamber 22) of the second cylinder 21.

The first cylinder 11 has a discharge port 18 for discharging gaseous refrigerant compressed in the first cylinder chamber 12. The discharge port 18 communicates with a through hole formed in the flange portion 60*b* of the first support member 60, and the through hole is provided with a shut-off valve 18*a* that is opened when the first cylinder chamber 12 reaches a predetermined pressure or higher. A discharge muffler 63 is attached to the first support member 60 and covers the shut-off valve 18*a* (i.e., the through hole). Similarly, the second cylinder 21 has a discharge port 28 for discharging gaseous refrigerant compressed in the second cylinder chamber 22. The discharge port 28 communicates with a through hole formed in the flange portion 70*b* of the second support member 70, and the through hole is provided with a shut-off valve 28*a* that is opened when the second cylinder chamber 22 reaches a predetermined pressure or higher. A discharge muffler 73 is attached to the second support member 70 and covers the shut-off valve 28*a* (i.e., the through hole).

[Characteristic Configuration of Compression Mechanism 99]

As described above, the first compression mechanism part 10 and the second compression mechanism part 20 basically have similar configurations, but are different in detail from each other in the following aspects.

(1) Pressing Force Applied to First Vane 14 and Second Vane 24

An intermediate pressure (from pressure of low-pressure refrigerant sucked into the first cylinder chamber 12 and the second cylinder chamber 22 to a discharge pressure) is applied to the front ends 14*a* and 24*a* of the first vane 14 and the second vane 24, a discharge pressure (pressure of the internal space 7 of the sealed container 3, that is, a pressure of high-pressure refrigerant compressed in the compression mechanism 99) is applied to the rear ends 14*b* and 24*b* thereof. Thus, a pressing force is applied to the first vane 14 and the second vane 24 in such a manner that the first vane 14 and the second vane 24 are pushed toward the first piston 13 and the second piston 23 in accordance with the difference in pressure applied to the front ends 14*a* and 24*a* and the rear ends 14*b* and 24*b*.

In addition to the pressing force, a pressing force pushing the first vane 14 toward the first piston 13 is applied to the first vane 14 by a compression spring 40. Thus, the first vane 14 is always pressed against the first piston 13 to partition the first cylinder chamber 12 into the suction chamber 12*a* and the compression chamber 12*b*. That is, the first compression mechanism part 10 including the first vane 14 always compresses refrigerant that has flowed into the first cylinder chamber 12.

On the other hand, the rear end 24*b* of the second vane 24 is pulled by a tension spring 50. Specifically, a drawing force is applied to the second vane 24 by a counterforce (elasticity force) of the tension spring 50 in such a manner the second vane 24 is moved away from an outer peripheral wall of the second piston 23 (in a direction of moving the second vane 24 toward the rear end 24*b*). Thus, a pressing force of pressing the vane toward the second piston 23 is smaller in the second vane 24 of the second compression mechanism part 20 than in the first vane 14 of the first compression mechanism part 10. In other words, a drawing force of moving the second vane 24 in a direction away from the outer peripheral wall of the second piston 23 is larger in the second vane 24 of the second compression mechanism part 20 than in the first vane 14 of the first compression mechanism part 10. Thus, in the second compression mechanism part 20, when the pressure difference between a pressure applied to the front end 24*a* and a pressure applied to the rear end 24*b* of the second vane 24 is greater than or equal to a predetermined value, that is, when a pressing force (a force that moves the second vane 24 toward the second piston 23) applied to the second vane 24 caused by the pressure difference is larger than a drawing force by the tension spring 50, the second cylinder chamber 22 is partitioned into the compression chamber and the suction chamber in a manner similar to the first compression mechanism part 10, and thereby, refrigerant that has flown into the second cylinder chamber 22 is compressed. On the other hand, in the second compression mechanism part 20, when the pressure difference between the pressure applied to the front end 24*a* of the second vane 24 and the pressure applied to the rear end 24*b* of the second vane 24 is smaller than the predetermined value, that is, when the drawing force by the tension spring 50 is greater than the pressing force applied to the second vane 24, caused by the pressure difference, the front end 24*a* of the second vane 24 moves to be separated from the second piston 23, and the second compression mechanism part 20 switches a cylinder cutoff state in which refrigerant in the second cylinder chamber 22 is not compressed.

(2) Retention Mechanism of Second Vane 24

The second compression mechanism part 20 including the tension spring 50 also includes a retention mechanism that retains the second vane 24 when the second vane 24 moves to be separated from the outer peripheral wall of the second piston 23. The retention mechanism according to Embodiment 1 includes a contact portion 52 disposed on the side of the rear end 24*b* of the second vane 24, a communication hole 51*a* formed in the second vane 24, and a communication hole 51*b* formed in the second cylinder 21.

The contact portion 52 separates the channel 30 and the vane rear chamber 25 from each other. The contact portion 52 has a communication hole 53 allowing the channel 30 to communicate with the vane rear chamber 25. Specifically, the communication hole 53 allows a space formed on the side of the rear end 24*b* of the second vane 24 to communicate with the internal space 7 of the sealed container 3. The contact portion 52 has a flat surface on the side of the second vane 24 to keep a certain degree of parallelism between the flat surface and the rear end 24*b* of the second vane 24.

The communication hole 51*a* formed in the second vane 24 has one end open to the rear end 24*b* (more specifically, at a location at which the communication hole 51*a* faces a portion of the contact portion 52 except the communication hole 53). The other end of the communication hole 51*a* is open to a side surface of the second vane 24.

The communication hole 51*b* formed in the second cylinder 21 has one end open to the vane groove 29. More specifically, this end of the communication hole 51*b* is open at such a location at which the communication hole 51*b* communicates with the communication hole 51*a* (at a location at which the open end of the communication hole 51*a* communicates with the open end of the communication hole 51*b*) in a state in which the second vane 24 moves to be separated from the outer peripheral wall of the second piston 23 so that the rear end 24*b* comes into contact with the contact portion 52. The other end of the communication hole 51*b* is open to the cylinder suction channel 27.

The communication holes 51*a* and 51*b* are not limited to the configurations described above as long as the rear end 24*b* of the second vane 24 communicates with the cylinder suction channel 27. For example, the other end of the communication hole 51 (i.e., the end that is open to the side surface of the second vane 24 in FIG. 2) may be open to the upper surface of the second vane 24. In this case, the communication hole 51*b* allowing this opening to communicate with the cylinder suction channel 27 includes a channel formed in the intermediate partition plate 4 communicating with the opening and a channel formed in the second cylinder 21 allowing the channel in the intermediate partition plate 4 to communicate with the cylinder suction channel 27.

For example, the other end of the communication hole 51*a* (i.e., the end that is open to the side surface of the second vane 24 in FIG. 2) may be open to a bottom surface of the second vane 24. In this case, the communication hole 51*b* allowing this opening to communicate with the cylinder suction channel 27 includes a channel formed in the flange portion 70*b* of the second support member 70 communicating with this opening and a channel formed in the second cylinder 21 allowing the channel in the flange portion 70*b* to communicate with the cylinder suction channel 27.

[Operation of Multi-Cylinder Rotary Compressor 100]

Operation of the thus-configured multi-cylinder rotary compressor 100 will be described.

[Operation in Refrigerant Compression by First Compression Mechanism Part 10 and Second Compression Mechanism Part 20]

First, operation of compressing refrigerant in both the first compression mechanism part 10 and the second compression mechanism part 20 will be described. This operation is similar to that of a typical multi-cylinder rotary compressor in which a compression mechanism part does not switch to a cylinder cutoff state. The operation will be described in detail below.

When power is supplied to the electric motor 8, the electric motor 8 causes the drive shaft 5 to rotate counterclockwise when viewed directly from above (i.e., rotate by a rotational phase θ with respect to the vane location as shown in FIG. 2). The rotation of the drive shaft 5 causes the eccentric-pin shaft portion 5*c* to eccentrically rotate in the first cylinder chamber 12 and the eccentric-pin shaft portion 5*d* to eccentrically rotate in the second cylinder chamber 22. The eccentric-pin shaft portion 5*c* and the eccentric-pin shaft portion 5*d* eccentrically rotate with a shift of 180 degrees relative to each other.

The eccentric rotation of the eccentric-pin shaft portion 5*c* causes the first piston 13 to eccentrically rotate in the first cylinder chamber 12 so that low-pressure gaseous refrigerant sucked into the first cylinder chamber 12 from the outlet pipe 6*c* of the suction muffler 6 through of the cylinder suction channel 17 is compressed. Similarly, the eccentric rotation of the eccentric-pin shaft portion 5*d* causes the second piston 23 to eccentrically rotate in the second cylinder chamber 22 so that low-pressure gaseous refrigerant sucked into the second cylinder chamber 22 from the outlet pipe 6*d* of the suction muffler 6 through the cylinder suction channel 27 is compressed.

When the gaseous refrigerant compressed in the first cylinder chamber 12 reaches a predetermined pressure, this refrigerant is discharged into the discharge muffler 63 from the discharge port 18, and then is discharged into the internal space 7 of the sealed container 3 from a discharge port of the discharge muffler 63. When gaseous refrigerant compressed in the second cylinder chamber 22 reaches a predetermined pressure, this refrigerant is discharge into the discharge muffler 73 from the discharge port 28, and then is discharge into the internal space 7 of the sealed container 3 from a discharge port of the discharge muffler 73. The high-pressure gaseous refrigerant discharged into the internal space 7 of the sealed container 3 is discharged to the outside of the sealed container 3 from the compressor discharge pipe 2.

In compressing refrigerant in the first compression mechanism part 10 and the second compression mechanism part 20, the suction operation and the compression operation of refrigerant described above are repeated in the first compression mechanism part 10 and the second compression mechanism part 20.

[Operation of Switching Second Compression Mechanism Part 20 to Cylinder Cutoff State]

Figure 3:
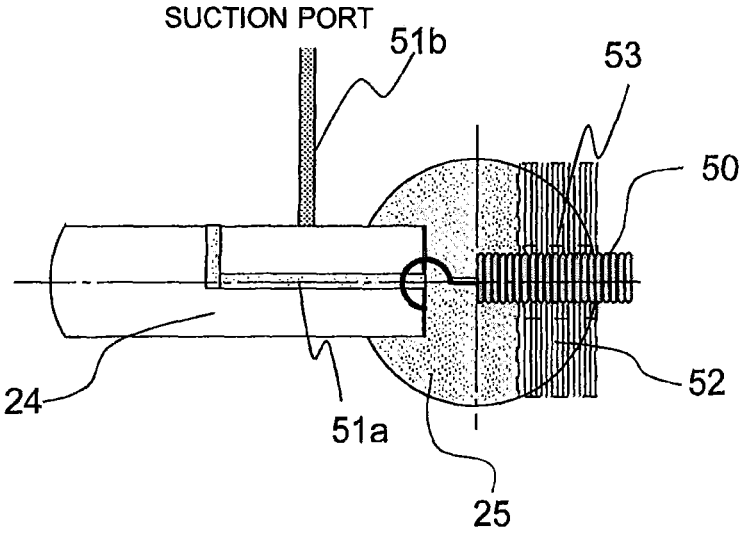
FIG. 3 shows enlarged views of a main portion illustrating the vicinity of a second vane 24 of the second compression mechanism part 20 of the multi-cylinder rotary compressor 100 according to Embodiment 1 of the present invention.
Figure 3:
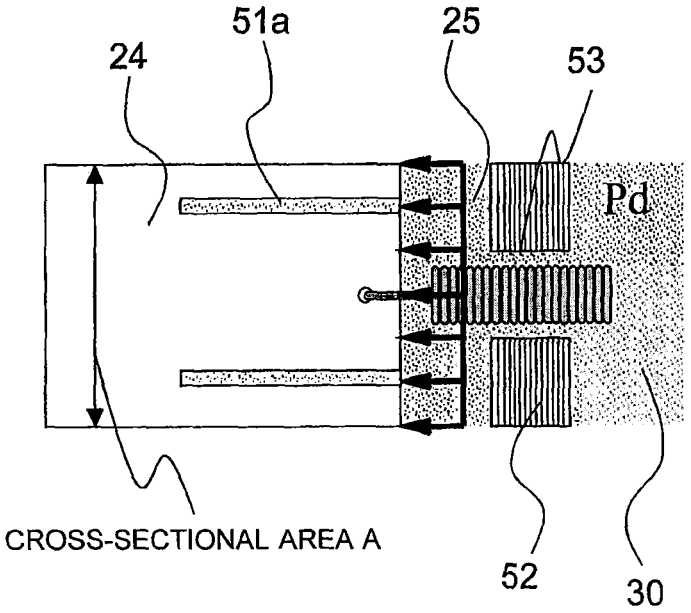
Figure 4:
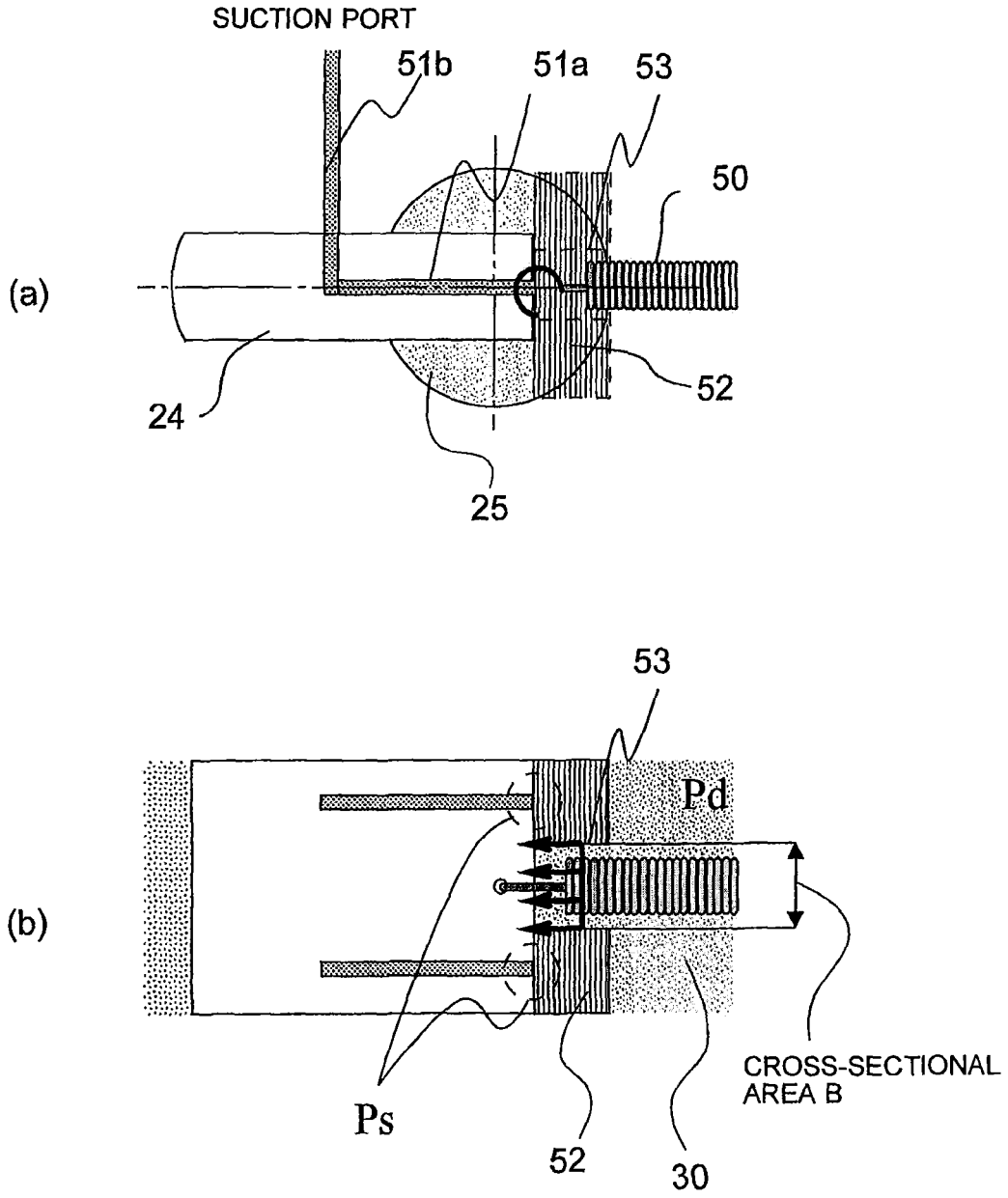
FIG. 4 shows enlarged views of a main portion illustrating the vicinity of the second vane 24 of the second compression mechanism part 20 of the multi-cylinder rotary compressor 100 according to Embodiment 1 of the present invention.

FIGS. 3 and 4 are enlarged views of a main portion illustrating the vicinity of the second vane 24 of the second compression mechanism part 20 of the multi-cylinder rotary compressor 100 according to Embodiment 1 of the present invention. FIG. 3 shows the vicinity of the second vane 24 in a state in which the second compression mechanism part 20 performs a refrigerant compression operation, where (a) is a transverse sectional view of the vicinity of the second vane 24 and (b) is a longitudinal sectional view of the vicinity of the second vane 24. FIG. 4 shows the vicinity of the second vane 24 of the second compression mechanism part 20 in a cylinder cutoff state (a state in which no refrigerant compression operation is performed), where (a) is a transverse sectional view of the vicinity of the second vane 24 and (b) is a longitudinal sectional view of the vicinity of the second vane 24.

Referring to FIGS. 1 to 4, an operation in which the second compression mechanism part 20 switches to a cylinder cutoff state will be described. During this operation, in the first compression mechanism part 10, the first vane 14 pressed by the compression spring 40 is also always in contact with the first piston 13 and refrigerant compression operation similar to that described above is performed. Thus, operation of the second compression mechanism part 20 in which the second compression mechanism part 20 switches to a cylinder cutoff state will be described.

In the above-described state in which the second compression mechanism part 20 compresses refrigerant, a discharge pressure is applied to the entire rear end 24*b* of the second vane 24 through lubricating oil. Thus, a pressing force occurring due to a difference in the pressure applied to the front end 24*a* and the pressure applied to the rear end 24*b* of the second vane 24 is greater than a drawing force by the tension spring 50 so that the front end 24*a* of the second vane 24 is pressed against the outer peripheral wall of the second piston 23. Thus, in the second compression mechanism part 20, refrigerant is compressed with rotation of the drive shaft 5.

In this state, as illustrated in FIG. 3, the position of the communication hole 51*a* formed in the second vane 24 does not coincide with the location of the communication hole 51*b* formed in the second cylinder 21. Thus, the communication hole 51*a* in the second vane 24 is closed by a side wall of the vane groove 29, and the communication hole 51*b* in the second cylinder 21 is closed by a side surface of the second vane 24. Consequently, the inside of the communication hole 51*a* formed in the second vane 24 is under a discharge pressure.

On the other hand, immediately after startup of operation of the multi-cylinder rotary compressor 100 or a state in which the multi-cylinder rotary compressor 100 is under a low load, the pressure of the internal space 7 of the sealed container 3 is low. Thus, a drawing force by the tension spring 50 is greater than a pressing force occurring due to a pressure difference between the pressure applied to the front end 24*a* and the pressure applied to the rear end 24*b* of the second vane 24. Consequently, a discharge pressure is applied to the entire rear end 24*b* of the second vane 24, and with a suction pressure applied to the entire front end 24*a* of the second vane 24, the second vane 24 moves to be separated from the outer peripheral wall of the second piston 23 so that the second compression mechanism part 20 switches to a cylinder cutoff state.

When the second vane 24 then moves further away from the outer peripheral wall of the second piston 23, the opening of the communication hole 51*a* formed in the second vane 24 and the opening of the communication hole 51*b* formed in the second cylinder 21 start overlapping each other, as illustrated in FIG. 4. That is, the communication hole 51*a* in the second vane 24 communicates with the cylinder suction channel 27 under a suction pressure, and thus, lubricating oil around the opening on the side of the rear end 24*b* of the communication hole 51*a* flows into the cylinder suction channel 27 through the communication hole 51*a* and the communication hole 51*b* so that the pressing force applied to the rear end 24*b* of the second vane 24 decreases. In this manner, the second vane 24 moves further away from the outer peripheral wall of the second piston 23, and the rear end 24*b* of the second vane 24 comes into contact with the contact portion 52.

In the state in which the rear end 24*b* of the second vane 24 is in contact with the contact portion 52, the discharge pressure is applied only to a portion of the rear end 24*b* of the second vane 24 facing the communication hole 53 of the contact portion 52. Thus, the pressing force applied to the second vane 24 further decreases so that the difference between the drawing force and the pressing force increases to be distinct. As a result, the second vane 24 is stably retained while being separated from the outer peripheral wall of the second piston 23.

[Operation of Cancelling Cylinder Cutoff State of Second Compression Mechanism Part 20]

Operation of cancelling the cylinder cutoff state of the second compression mechanism part 20 will be described. When the pressure (discharge pressure) of the internal space 7 of the sealed container 3 increases with the second vane 24 being stably retained, the pressing force occurring due to the pressure difference between the "suction pressure applied to the entire front end 24*a* of the second vane 24" and the "discharge pressure applied to the portion of the rear end 24*b* of the second vane 24 facing the communication hole 53 of the contact portion 52" becomes greater than the drawing force by the tension spring 50. In this state, the second vane 24 is separated from the contact portion 52 so that retention of the second vane 24 is cancelled.

Once the second vane 24 becomes separated from the contact portion 52, the location of the communication hole 51*a* in the second vane 24 does not coincide with the location of the communication hole 51*b* in the second cylinder 21 any more so that the suction pressure is not introduced. In addition, lubricating oil is supplied onto the entire rear end 24*b* of the second vane 24, a discharge pressure is applied to the entire rear end 24*b* of the second vane 24, and a pressing force applied to the second vane 24 increases. In this manner, the difference between the pressing force applied to the second vane 24 and the drawing force becomes distinct so that the second vane 24 moves toward the second piston 23. Consequently, the front end 24*a* of the second vane 24 is pressed against the outer peripheral wall of the second piston 23 so that the second compression mechanism part 20 starts compression of refrigerant.

In a state in which the second vane 24 is stably retained, the cylinder cutoff state of the second compression mechanism part 20 can be maintained by keeping the pressure applied to the portion of the rear end 24*b* of the second vane 24 facing the communication hole 53 in the contact portion 52 below a predetermined pressure, that is, by keeping the pressure difference between the "suction pressure applied to the entire front end 24*a* of the second vane 24" and the "discharge pressure applied to the portion of the rear end 24*b* of the second vane 24 facing the communication hole 53 in the contact portion 52" at a predetermined value or less. In a state in which the front end 24*a* of the second vane 24 is pressed against the outer peripheral wall of the second piston 23, the refrigerant compressed state of the second compression mechanism part 20 can be maintained by keeping the pressure difference between the "suction pressure applied to the entire front end 24*a* of the second vane 24" and the "discharge pressure applied to the entire rear end 24*b* of the second vane 24" at a predetermined value or more.

[Relationship Between Pressure Applied to Second Vane 24 and Operation of Second Vane 24]

Figure 5:
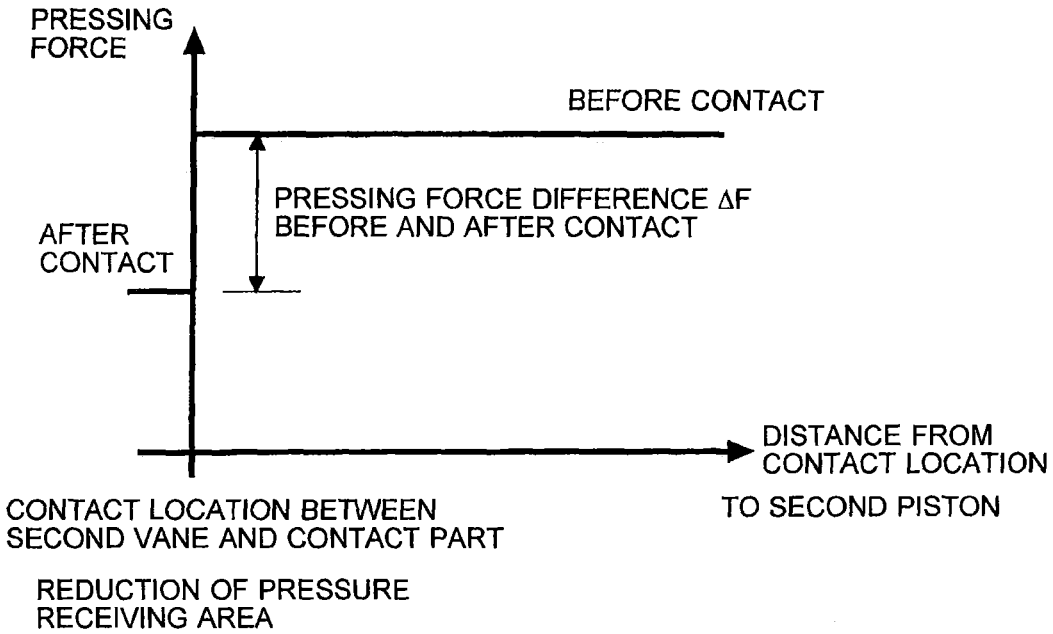
FIG. 5 is a graph showing a relationship between the location of the second vane 24 and a pressing force generated by a pressure applied to the second vane 24 in the multi-cylinder rotary compressor 100 according to Embodiment 1 of the present invention.
Figure 6:
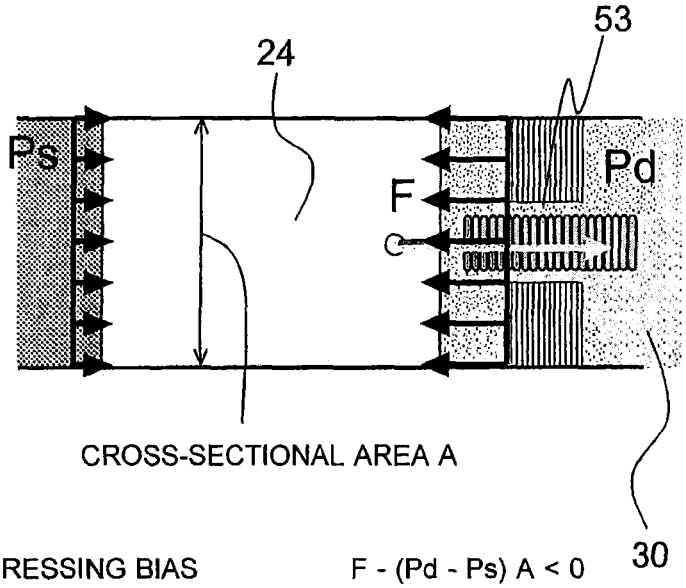
FIG. 6 shows illustrations for describing a relationship between the pressing force and a drawing force applied to the second vane 24 in the multi-cylinder rotary compressor 100 according to Embodiment 1 of the present invention.
Figure 6:
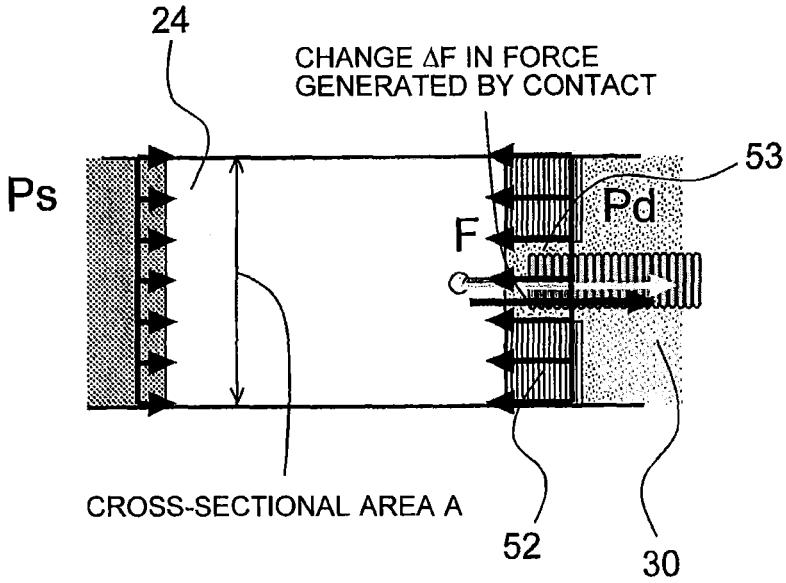

FIG. 5 is a graph showing a relationship between the location of the second vane 24 and a pressing force generated by a pressure applied to the second vane 24 in the multi-cylinder rotary compressor 100 according to Embodiment 1 of the present invention. FIG. 6 shows illustrations for describing a relationship between the pressing force and a drawing force applied to the second vane 24 in the multi-cylinder rotary compressor 100 according to Embodiment 1 of the present invention. FIG. 6 (*a*) is a side view showing a state in which the second vane 24 is not in contact with the contact portion 52, and FIG. 6 (*b*) is a side view showing a state in which the second vane 24 is in contact with the contact portion 52.

A suction pressure Ps is applied to the front end 24*a* of the second vane 24, and a discharge pressure Pd is applied to the rear end 24*b* of the of the second vane 24. A drawing force F by the tension spring 50 is also applied to the second vane 24. The state of the second vane 24 is determined depending on the relationship among Ps, Pd, and F applied to the second vane 24.

First, the state in which the second vane 24 is not in contact with the contact portion 52 will be described.

The sectional area of the second vane 24 perpendicular to the direction in which the second vane 24 moves (approximated to the surface area of the front end 24*a* and the rear end 24*b*) is assumed to be A, in the state in which the second vane 24 is not in contact with the contact portion 52, the pressing force applied to the second vane 24 under the suction pressure Ps and the discharge pressure Pd is (Pd−Ps) A. Thus, in the refrigerant compressed state in which the second vane 24 is pressed against the second piston 23, the relationship of F−(Pd−Ps) A<0 is established. In the uncompressed state in which the second vane 24 is separated from the second piston 23, the relationship of F−(Pd−Ps) A>0 is established.

Next, the state in which the second vane 24 is in contact with the contact portion 52 will be described.

When the second vane 24 comes into contact with the contact portion 52, the area (pressure receiving area) in which the discharge pressure Pd is applied to the second vane 24 decreases to a cross-sectional area B of the communication hole 53 formed in the contact portion 52. A change ΔF of the pressing force due to the decrease of the pressure receiving area is expressed as ΔF=(Pd−Ps)×(A−B), and it is supposed that a drawing force is applied by the amount corresponding to this change (similarly to a magnetic force and a friction force, for example, used in other embodiments described later). That is, ΔF is a difference between the "difference between the drawing force and the pressing force in the state in which the second vane 24 is in contact with the contact portion 52 (the state in which the retention mechanism retains the second vane 24)" and the "difference between the drawing force and the pressing force in the state in which the second vane 24 is separated from the second piston 23 and the second vane 24 is not in contact with the contact portion 52 (the state in which the retention mechanism does not retain the second vane 24)." Thus, in the state in which the second vane 24 is in contact with the contact portion 52, depending on the relationship among Ps, Pd, and F applied to the second vane 24, the second vane 24 operates as follows. Specifically, in the state in which the second vane 24 is stably retained, the relationship of F+ΔF−(Pd−Ps) A>0 is established. In a state in which the retention of the second vane 24 is cancelled, the relationship of F+ΔF−(Pd−Ps) A<0 is established.

As described above, in the multi-cylinder rotary compressor 100 having the configuration described in Embodiment 1, the pressing force of pressing the second vane 24 against the second piston 23 in the second compression mechanism part 20 is smaller than that in the first compression mechanism part 10. Thus, when the pressing force decreases below a predetermined value of a pressure applied to the rear end 24*b* of the second vane 24, the second vane 24 of the second compression mechanism part 20 moves to be separated from the second piston 23 so that the second compression mechanism part 20 switches to the cylinder cutoff state. Consequently, the multi-cylinder rotary compressor 100 according to Embodiment 1 can reduce a compressor loss under a low load condition and increase the compressor efficiency and the capacity range, thereby enhancing energy saving performance in an actual load operation. With these advantages, the multi-cylinder rotary compressor 100 according to Embodiment 1 does not require a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented.

In the multi-cylinder rotary compressor 100 according to Embodiment 1, the second compression mechanism part 20 includes the retention mechanism that retains the second vane 24 by coming into contact with the second vane 24 when the second vane 24 moves to be separated from the second piston 23. Thus, the multi-cylinder rotary compressor 100 according to Embodiment 1 can stably retain the location of the second vane 24 when the second vane 24 moves to be separated from the outer peripheral wall of the second piston 23.

In the example of Embodiment 1, the second compression mechanism part 20 to be in the cylinder cutoff state is disposed below the first compression mechanism part 10. Alternatively, the second compression mechanism part 20 to be in a cylinder cutoff state may be, of course, disposed above the first compression mechanism part 10.

In Embodiment 1, the multi-cylinder rotary compressor 100 of the high-pressure hermetically sealed shell type has been described. However, advantages similar to those obtained in Embodiment 1 can be obtained by employing the second compression mechanism part 20 according to Embodiment 1 in a multi-cylinder rotary compressor of another shell type. For example, advantages similar to those obtained in Embodiment 1 can be obtained by employing the second compression mechanism part 20 according to Embodiment 1 in a multi-cylinder rotary compressor of a semi-closed type or a multi-cylinder rotary compressor of an intermediate shell type.

In Embodiment 1, the multi-cylinder rotary compressor 100 including the two compression mechanism parts has been described. Alternatively, the multi-cylinder rotary compressor 100 may include three or more compression mechanism parts. Advantages similar to those obtained in Embodiment 1 can be obtained by providing some of the compression mechanism parts with a configuration similar to that of the second compression mechanism part 20.

Embodiment 2

In Embodiment 1, the retention mechanism includes the contact portion 52 on the side of the rear end 24*b* of the second vane 24, the communication hole 51*a* formed in the second vane 24, and the communication hole 51*b* formed in the second cylinder 21. However, the retention mechanism may not include the communication holes 51*a* and 51*b* as described below. Part of the configuration not specifically described in Embodiment 2 is similar to that of Embodiment 1, and the same functions and components are denoted by the same reference signs.

Figure 7:
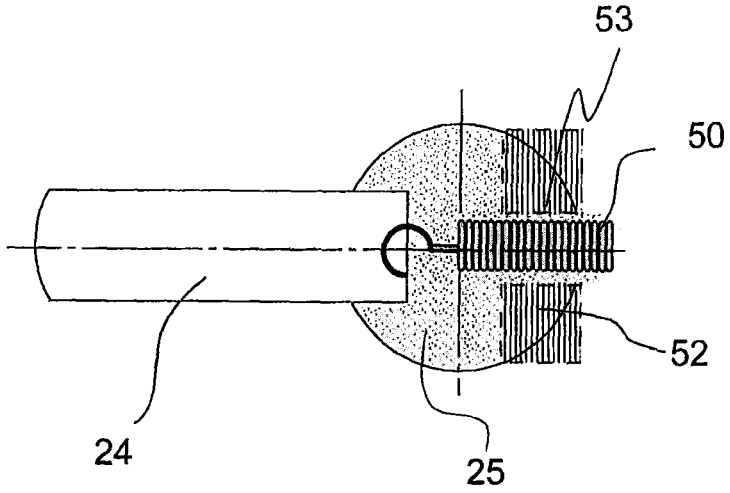
FIG. 7 shows enlarged views of a main portion illustrating the vicinity of a second vane 24 of a second compression mechanism part 20 of a multi-cylinder rotary compressor 100 according to Embodiment 2 of the present invention.
Figure 7:
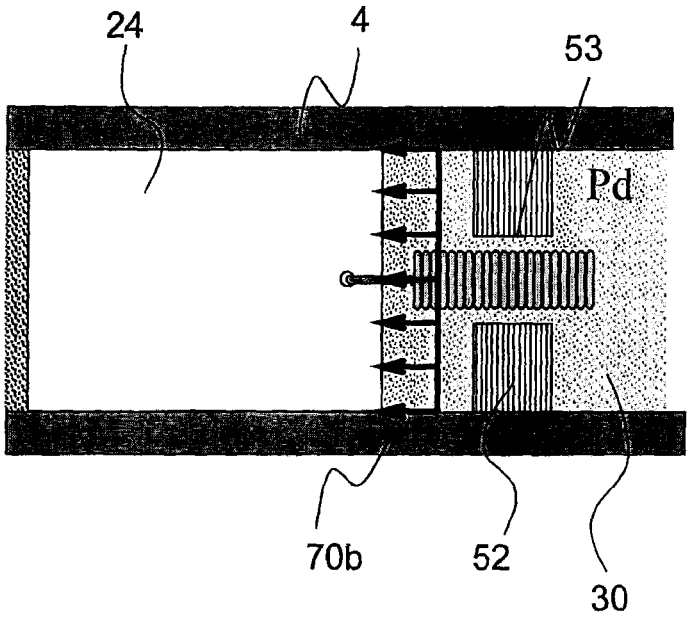
Figure 8:
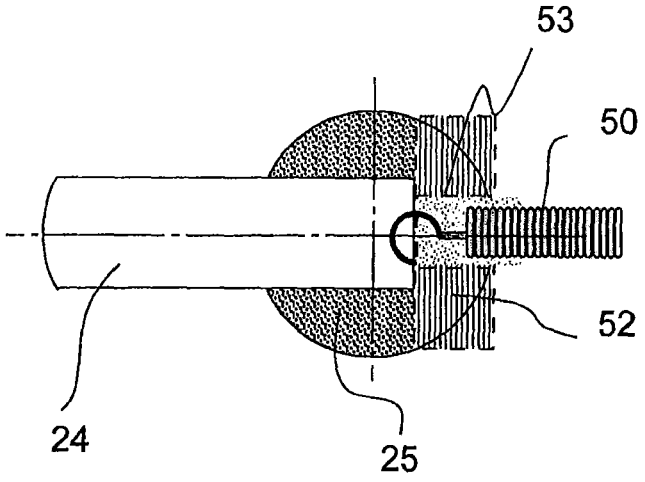
FIG. 8 shows enlarged views of the main portion illustrating the vicinity of the second vane 24 of the second compression mechanism part 20 of the multi-cylinder rotary compressor 100 according to Embodiment 2 of the present invention.
Figure 8:
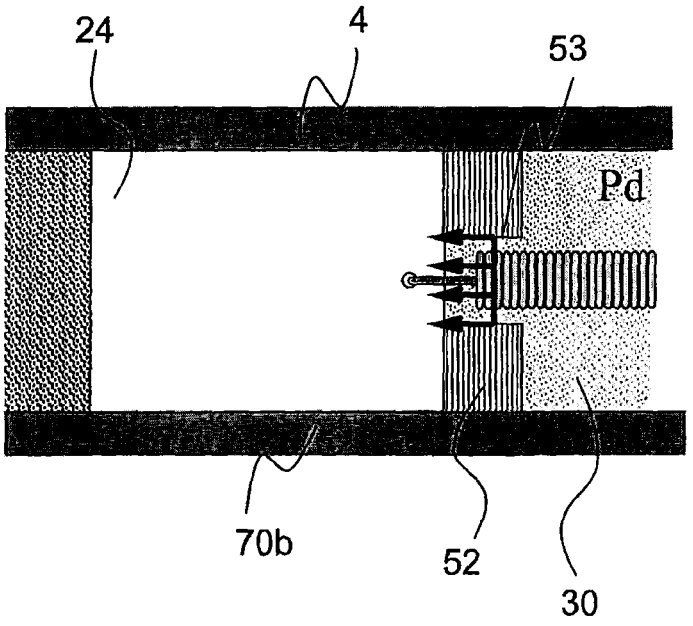

FIGS. 7 and 8 are enlarged views of a main portion illustrating the vicinity of a second vane 24 of a second compression mechanism part 20 of a multi-cylinder rotary compressor 100 according to Embodiment 2 of the present invention. FIG. 7 shows the vicinity of the second vane 24 in a state in which the second compression mechanism part 20 performs a refrigerant compression operation, where (a) is a transverse sectional view of the vicinity of the second vane 24 and (b) is a longitudinal sectional view of the vicinity of the second vane 24. FIG. 8 shows the vicinity of the second vane 24 of the second compression mechanism part 20 in a cylinder cutoff state, where (a) is a transverse sectional view of the vicinity of the second vane 24 and (b) is a longitudinal sectional view of the vicinity of the second vane 24.

In the second compression mechanism part 20 of the multi-cylinder rotary compressor 100 according to Embodiment 2, an upper opening of a vane rear chamber 25 is closed with an intermediate partition plate 4, and a lower opening of the vane rear chamber 25 is closed with a flange portion 70*b* of a second support member 70. Thus, a channel allowing the vane rear chamber 25 to communicate with an internal space 7 of a sealed container 3 is constituted only by a communication hole 53 formed in a contact portion 52. In a manner similar to Embodiment 1, the contact portion 52 has a flat surface on the side of the second vane 24 to keep a certain degree of parallelism between the flat surface and a rear end 24*b* of the second vane 24.

In a manner similar to Embodiment 1, in the multi-cylinder rotary compressor 100 having the configuration according to Embodiment 2, in a case where a pressing force occurring due to a pressure difference between a "suction pressure applied to the entire front end 24*a* of the second vane 24" and a "discharge pressure applied to the entire rear end 24*b* of the second vane 24" is greater than a drawing force by a tension spring 50, a front end 24*a* of the second vane 24 is pressed against the outer peripheral wall of a second piston 23, and the second compression mechanism part 20 compresses refrigerant.

On the other hand, when a pressure (discharge pressure) of the internal space 7 of the sealed container 3 decreases, the drawing force by the tension spring 50 increases above the pressing force occurring due to the pressure difference between the "suction pressure applied to the entire front end 24*a* of the second vane 24" and the "discharge pressure applied to the entire rear end 24*b* of the second vane 24," the second vane 24 moves to be separated from the outer peripheral wall of the second piston 23, and the second compression mechanism part 20 switches to a cylinder cutoff state. When the second vane 24 then moves further away from the outer peripheral wall of the second piston 23, the rear end 24*b* of the second vane 24 comes into contact with the contact portion 52.

In the state in which the rear end 24*b* of the second vane 24 is in contact with the contact portion 52, a discharge pressure is applied only to a portion of the rear end 24*b* of the second vane 24 facing the communication hole 53 in the contact portion 52. Thus, in a manner similar to Embodiment 1, a pressing force applied to the second vane 24 further decreases so that the difference between the drawing force and the pressing force increases to be distinct. As a result, the second vane 24 is stably retained while being separated from the outer peripheral wall of the second piston 23.

As described above, in a manner similar to Embodiment 1, the multi-cylinder rotary compressor 100 having the configuration described in Embodiment 2 can allow the second compression mechanism part 20 to switch to the cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In a manner similar to Embodiment 1, the multi-cylinder rotary compressor 100 according to Embodiment 2 can stably retain the location of the second vane 24 when the second vane 24 moves to be separated from the outer peripheral wall of the second piston 23.

In the multi-cylinder rotary compressor 100 according to Embodiment 2, the channel allowing the vane rear chamber 25 to communicate with the internal space 7 of the sealed container 3 is constituted only by the communication hole 53 in the contact portion 52. Thus, to bring the second vane 24 separated from the second piston 23 into contact with the contact portion 52, lubricating oil in the vane rear chamber 25 needs to flow into the second cylinder chamber 22 through a clearance between the second vane 24 and the vane groove 29. Consequently, as compared to Embodiment 1, it takes time for the multi-cylinder rotary compressor 100 according to Embodiment 2 to switch the second vane 24 to a stable retention state (in which the second vane 24 is in contact with the contact portion 52). However, since the multi-cylinder rotary compressor 100 according to Embodiment 2 does not need to form the communication holes 51*a* and 51*b* in, for example, the second vane 24 and the second cylinder 21, costs for the multi-cylinder rotary compressor 100 can be further reduced.

Embodiment 3

Although a material for the contact portion 52 has not been specifically mentioned in Embodiments 1 and 2, the contact portion 52, for example, may be composed of a magnet (a contact portion 52 composed of a magnet will be hereinafter referred to as a magnet 54). Part of the configuration not specifically described in Embodiment 3 is similar to those of Embodiments 1 and 2, and the same functions and components are denoted by the same reference signs.

Figure 9:
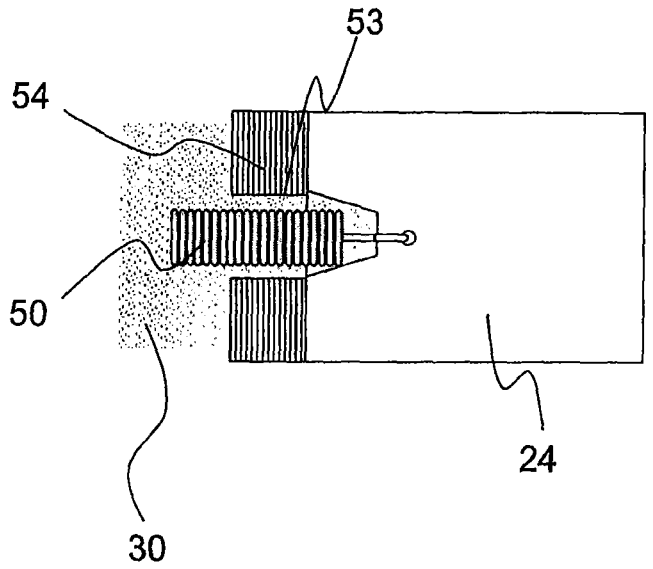
FIG. 9 is a longitudinal sectional view illustrating the vicinity of a second vane 24 of a second compression mechanism part 20 of a multi-cylinder rotary compressor 100 according to Embodiment 3 of the present invention.

FIG. 9 is a longitudinal sectional view illustrating the vicinity of a second vane 24 of a second compression mechanism part 20 of a multi-cylinder rotary compressor 100 according to Embodiment 3 of the present invention. In FIG. 9, the second vane 24 is in contact with (is stably retained by) a magnet 54 that is a contact portion 52.

Figure 10:
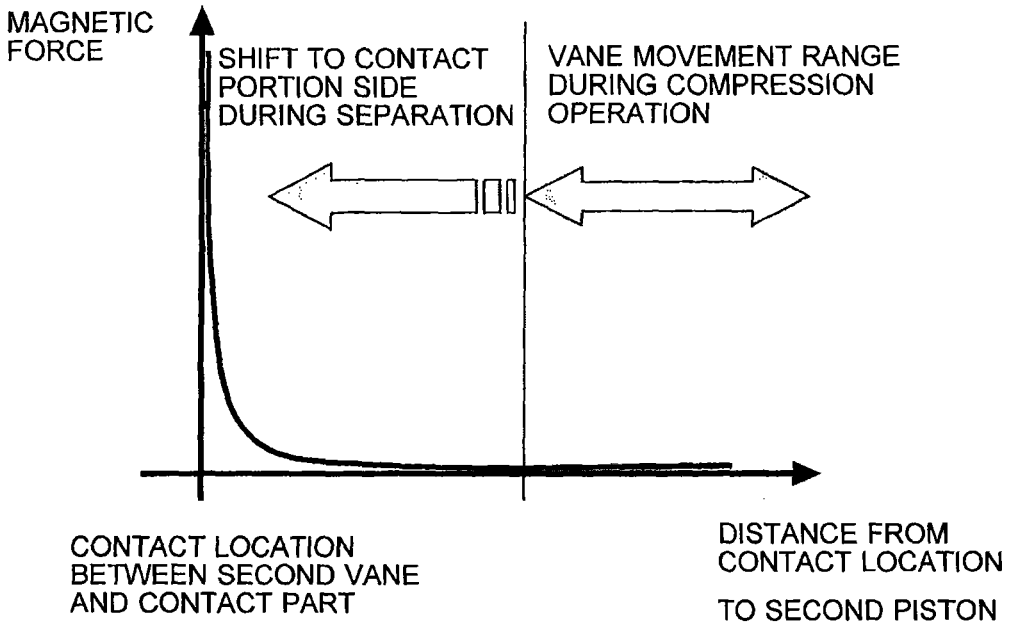
FIG. 10 shows a relationship between a distance from a magnet 54 to the second vane 24 and a magnetic force applied to the second vane 24 in the multi-cylinder rotary compressor 100 according to Embodiment 3 of the present invention.

FIG. 10 shows a relationship between a distance from the magnet 54 to the second vane 24 and a magnetic force applied to the second vane 24 in the multi-cylinder rotary compressor 100 according to Embodiment 3 of the present invention.

As shown in FIG. 10, the magnetic force of the magnet 54 applied to the second vane 24 is at the maximum when the second vane 24 is in contact with the magnet 54, attenuates as the second vane 24 moves away from the magnet 54, and reaches a negligible degree when the second vane 24 is away from the magnet 54 at a certain distance or more. That is, in a state in which a front end 24*a* of the second vane 24 is pressed against an outer peripheral wall of a second piston 23 so that the second compression mechanism part 20 compresses refrigerant, the second vane 24 is separated from the magnet 54 at a certain distance or more. Thus, only a drawing force by a tension spring 50 and a pressing force occurring due to a pressure difference between a "suction pressure applied to the entire front end 24*a* of the second vane 24" and a "discharge pressure applied to the entire rear end 24*b* of the second vane 24" are applied to the second vane 24.

On the other hand, when a pressure (discharge pressure) of an internal space 7 of a sealed container 3 decreases, the drawing force by the tension spring 50 becomes greater than the pressing force occurring due to the pressure difference between the "suction pressure applied to the entire front end 24*a* of the second vane 24" and the "discharge pressure applied to the entire rear end 24*b* of the second vane 24," the second vane 24 moves to be separated from the outer peripheral wall of the second piston 23, and the second compression mechanism part 20 switches to a cylinder cutoff state. When the second vane 24 then moves further away from the outer peripheral wall of the second piston 23, a drawing force caused by a magnetic force of the magnet 54 is applied to the second vane 24, in addition to the drawing force by the tension spring 50. Thus, the difference between the pressing force and the drawing force applied to the second vane 24 increases to be distinct so that the second vane 24 moves further away from the outer peripheral wall of the second piston 23 to come into contact with the magnet 54.

In the state in which the rear end 24*b* of the second vane 24 is in contact with the magnet 54, a discharge pressure is applied only to a portion of the rear end 24*b* of the second vane 24 facing a communication hole 53 in the magnet 54. Thus, in a manner similar to Embodiments 1 and 2, the pressing force applied to the second vane 24 further decreases so that the difference between the drawing force and the pressing force increases to be distinct. As a result, the second vane 24 is stably retained while being separated from the outer peripheral wall of the second piston 23.

As described above, in a manner similar to Embodiments 1 and 2, the multi-cylinder rotary compressor 100 having the configuration as described in Embodiment 3 can allow a second compression mechanism part 20 to switch to the cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In a manner similar to Embodiments 1 and 2, the multi-cylinder rotary compressor 100 according to Embodiment 3 can stably retain the location of the second vane 24 when the second vane 24 moves to be separated from the outer peripheral wall of the second piston 23.

Since the multi-cylinder rotary compressor 100 according to Embodiment 3 uses the magnet 54, the magnetic force of the magnet 54 needs to be controlled. However, the configuration of the multi-cylinder rotary compressor 100 as described in Embodiment 3 enables the magnetic force of the magnet 54 to more stably retain the second vane 24 separated from the second piston 23.

Embodiment 4

The configuration of the retention mechanism is not limited to those described in Embodiments 1 to 3, and may be the configuration as follows. Part of the configuration not specifically described in Embodiment 4 is similar to that of one of Embodiments 1 to 3, and the same functions and components are denoted by the same reference signs.

Figure 11:
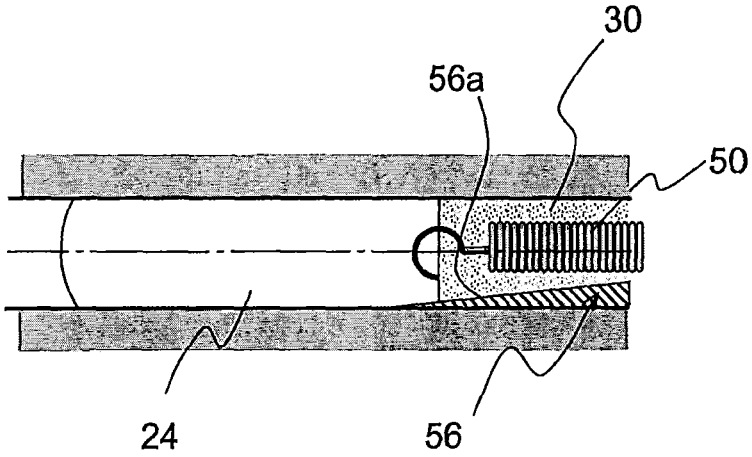
FIG. 11 shows enlarged views of a main portion illustrating the vicinity of a second vane 24 of a second compression mechanism part 20 of a multi-cylinder rotary compressor 100 according to Embodiment 4 of the present invention.
Figure 11:
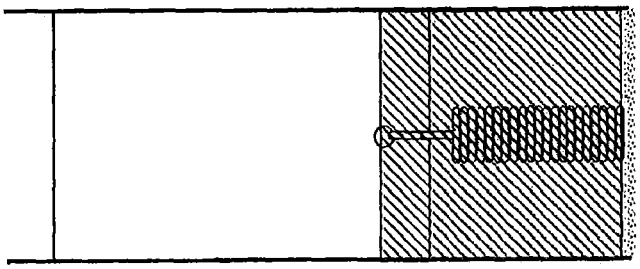

FIG. 11 shows enlarged views of a main portion illustrating the vicinity of a second vane 24 of a second compression mechanism part 20 of a multi-cylinder rotary compressor 100 according to Embodiment 4 of the present invention. FIG. 11(*a*) is a transverse sectional view illustrating the vicinity of the second vane 24, and FIG. 11(*b*) is a longitudinal sectional view illustrating the vicinity of the second vane 24. In FIG. 11, the second vane 24 is stably retained.

As illustrated in FIG. 11, the multi-cylinder rotary compressor 100 according to Embodiment 4 includes a friction member 56 as a contact portion 52 of a retention mechanism. The friction member 56 is provided in a vane rear chamber 25. The friction member 56 has a sloped surface 56*a* that is tilted relative to a side surface of a vane groove 29.

In the multi-cylinder rotary compressor 100 having the configuration described in Embodiment 4, in a case where a pressing force occurring due to a pressure difference between a "suction pressure applied to the entire front end 24*a* of the second vane 24" and a "discharge pressure applied to the entire rear end 24*b* of the second vane 24" is greater than a drawing force by a tension spring 50, the front end 24*a* of the second vane 24 is pressed against an outer peripheral wall of a second piston 23, and the second compression mechanism part 20 compresses refrigerant.

On the other hand, when a pressure (discharge pressure) of an internal space 7 of a sealed container 3 decreases, the drawing force by the tension spring 50 increases above the pressing force occurring due to the pressure difference between the "suction pressure applied to the entire front end 24*a* of the second vane 24" and the "discharge pressure applied to the entire rear end 24*b* of the second vane 24," the second vane 24 moves to be separated from the outer peripheral wall of the second piston 23, and the second compression mechanism part 20 switches to a cylinder cutoff state. When the second vane 24 then moves further away from the outer peripheral wall of the second piston 23, a side surface of the second vane 24 close to the rear end 24*b* thereof comes into contact with the friction member 56. In this state, when the second vane 24 starts moving toward the second piston 23, a friction force is generated between the second vane 24 and the friction member 56 so that the difference between the friction force and the pressing force increases to be distinct. As a result, the second vane 24 is stably retained while being separated from the outer peripheral wall of the second piston 23.

As described above, in a manner similar to Embodiments 1 to 3, the multi-cylinder rotary compressor 100 having the configuration described in Embodiment 4 can allow the second compression mechanism part 20 to switch to the cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In a manner similar to Embodiments 1 to 3, the multi-cylinder rotary compressor 100 according to Embodiment 4 can stably retain the location of the second vane 24 when the second vane 24 moves to be separated from the outer peripheral wall of the second piston 23.

In the multi-cylinder rotary compressor 100 having the configuration described in Embodiment 4, the surface state and lubrication state of the friction member 56 changes depending on the status of use, and the friction force changes accordingly. Thus, the multi-cylinder rotary compressor 100 having the configuration described in Embodiment 4 has the task that conditions change for obtaining the pressure difference (the difference in applied pressure between the front end 24*a* and the rear end 24*b* of the second vane 24) enough to retain the second vane 24.

Embodiment 5

The second compression mechanism part 20 of the multi-cylinder rotary compressor 100 described in each of Embodiments 1 to 4 includes the tension spring 50 that applies a drawing force to the second vane 24. However, the second vane 24 can move in the vane groove 29 only by using a pressure difference between a "suction pressure applied to the front end 24*a* of the second vane 24" and a "discharge pressure applied to the rear end 24*b* of the second vane 24." Thus, the present invention can be carried out with a configuration in which the tension spring 50 is not provided in the second compression mechanism part 20 of the multi-cylinder rotary compressor 100 described in each of Embodiments 1 to 4. Part of the configuration not specifically described in Embodiment 5 is similar to that of one of Embodiments 1 to 4, and the same functions and components are denoted by the same reference signs. In the following description, a multi-cylinder rotary compressor 100 according to Embodiment 5 will be described with reference to, for example, a configuration in which the tension spring 50 is removed from the second compression mechanism part 20 of the multi-cylinder rotary compressor 100 illustrated in Embodiment 3.

Figure 12:
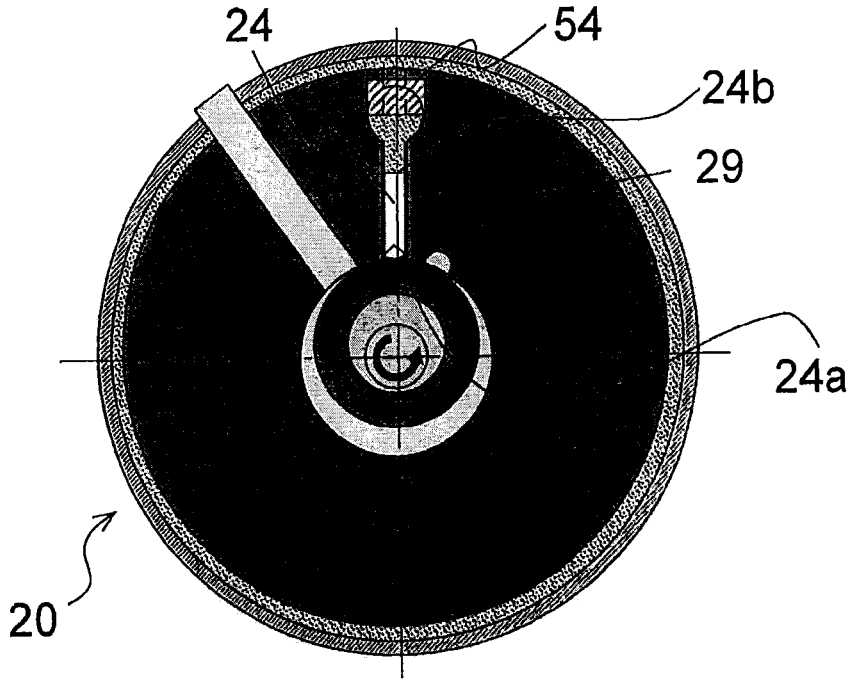
FIG. 12 shows transverse sectional views schematically illustrating a configuration of a second compression mechanism part 20 of a multi-cylinder rotary compressor 100 according to Embodiment 5 of the present invention, where (a) shows the second compression mechanism part 20 in a compressed state and (b) shows the second compression mechanism part 20 in an uncompressed state (cylinder cutoff state).
Figure 12:
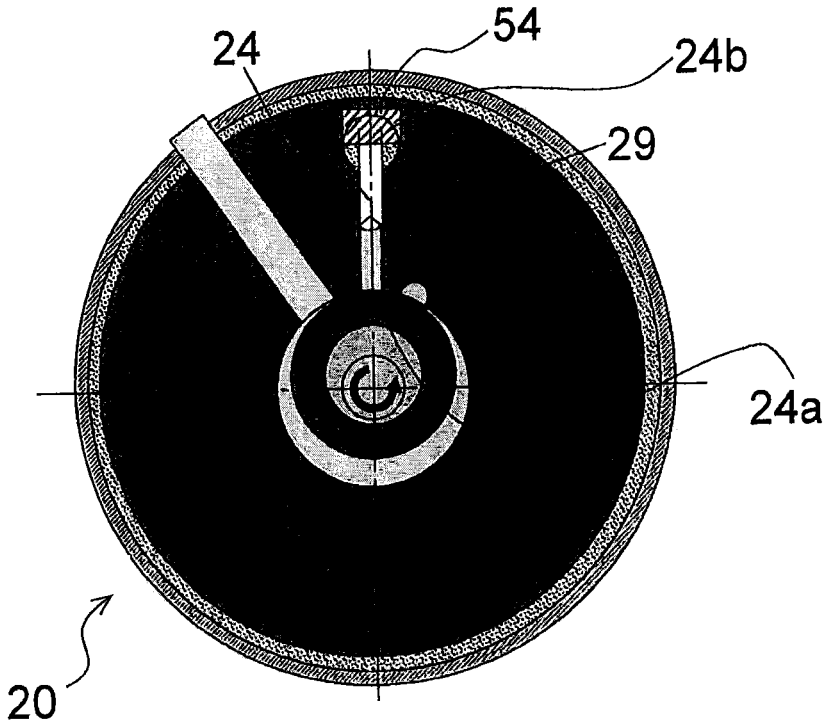

FIG. 12 shows transverse sectional views schematically illustrating a configuration of a second compression mechanism part 20 of the multi-cylinder rotary compressor 100 according to Embodiment 5 of the present invention, where (a) shows the second compression mechanism part 20 in a compressed state and (b) shows the second compression mechanism part 20 in an uncompressed state (cylinder cutoff state).

As illustrated in FIG. 12, the multi-cylinder rotary compressor 100 according to Embodiment 5 has a configuration in which the tension spring 50 is omitted from the second compression mechanism part 20 of the multi-cylinder rotary compressor 100 described in Embodiment 3.

When refrigerant is compressed in the first compression mechanism part 10, a first vane 14 moves in a vane groove 19 following eccentric rotation of a first piston 13 with a front end 14*a* of the first vane 14 being pressed against an outer peripheral wall of the first piston 13. Similarly, when refrigerant is compressed in the second compression mechanism part 20, a second vane 24 moves in the vane groove 29 following eccentric rotation of the second piston 23 with a front end 24*a* of the second vane 24 being pressed against an outer peripheral wall of the second piston 23. That is, when refrigerant is compressed in the first compression mechanism part 10 and the second compression mechanism part 20, an inertial force serving as a drawing force is applied to the first vane 14 and the second vane 24 in accordance with the eccentric rotation of the first piston 13 and the second piston 23.

Thus, in the multi-cylinder rotary compressor 100 having the configuration described in Embodiment 5, in a case where a pressing force occurring due to a pressure difference between a "suction pressure applied to the entire front end 24*a* of the second vane 24" and a "discharge pressure applied to the entire rear end 24*b* of the second vane 24" is greater than a drawing force by an inertial force, the front end 24*a* of the second vane 24 is pressed against the outer peripheral wall of the second piston 23, and the second compression mechanism part 20 compresses refrigerant.

On the other hand, when a pressure (discharge pressure) of an internal space 7 of a sealed container 3 decreases, the drawing force by the inertial force increases above the pressing force occurring due to the pressure difference between the "suction pressure applied to the entire front end 24*a* of the second vane 24" and the "discharge pressure applied to the entire rear end 24*b* of the second vane 24," the second vane 24 moves away from the outer peripheral wall of the second piston 23, and the second compression mechanism part 20 switches to a cylinder cutoff state. When the second vane 24 then moves further away from the outer peripheral wall of the second piston 23, the rear end 24*b* of the second vane 24 comes into contact with the magnet 54, and the second vane 24 is stably retained.

As described above, in a manner similar to Embodiments 1 to 4, the multi-cylinder rotary compressor 100 having the configuration described in Embodiment 5 can allow the second compression mechanism part 20 to switch to the cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In a manner similar to Embodiments 1 to 4, the multi-cylinder rotary compressor 100 according to Embodiment 5 can stably retain the location of the second vane 24 when the second vane 24 moves to be separated from the outer peripheral wall of the second piston 23.

Embodiment 6

In a case where a retention mechanism includes a contact portion 52, this contact portion 52 may have the following configuration. Part of the configuration not specifically described in Embodiment 6 is similar to that of one of Embodiments 1 to 5, and the same functions and components are denoted by the same reference signs.

Figure 13:
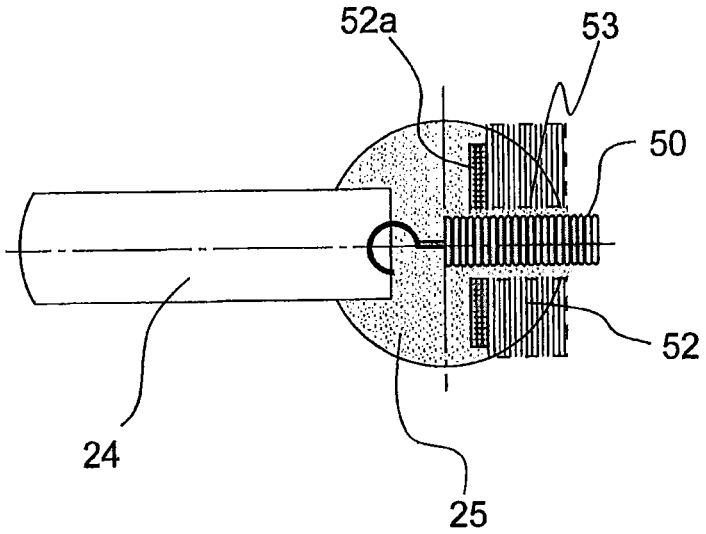
FIG. 13 shows enlarged views of a main portion illustrating the vicinity of a second vane 24 of a second compression mechanism part 20 of a multi-cylinder rotary compressor 100 according to Embodiment 6 of the present invention.
Figure 13:
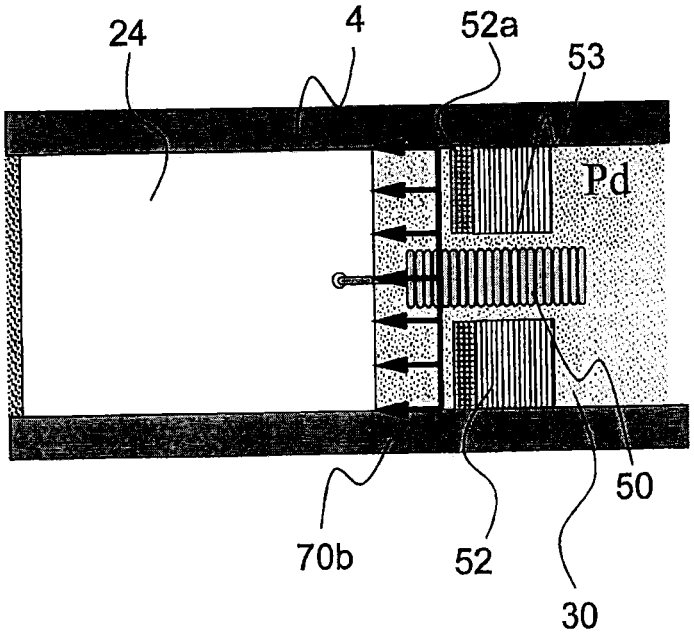
Figure 14:
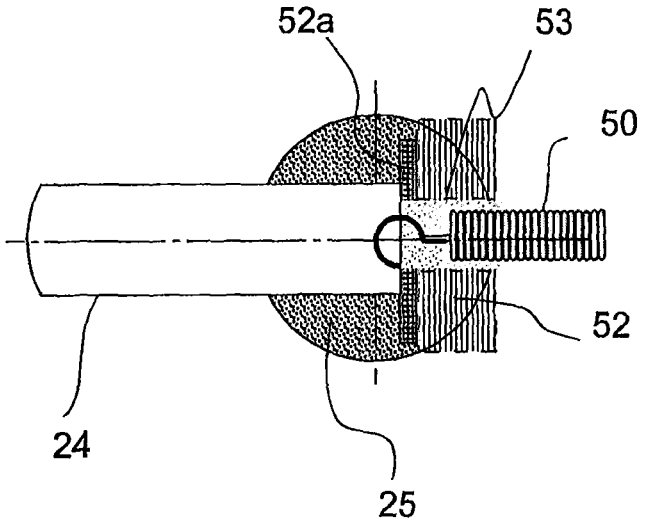
FIG. 14 illustrates enlarged views of a main portion illustrating the vicinity of the second vane 24 of the second compression mechanism part 20 of the multi-cylinder rotary compressor 100 according to Embodiment 6 of the present invention.
Figure 14:
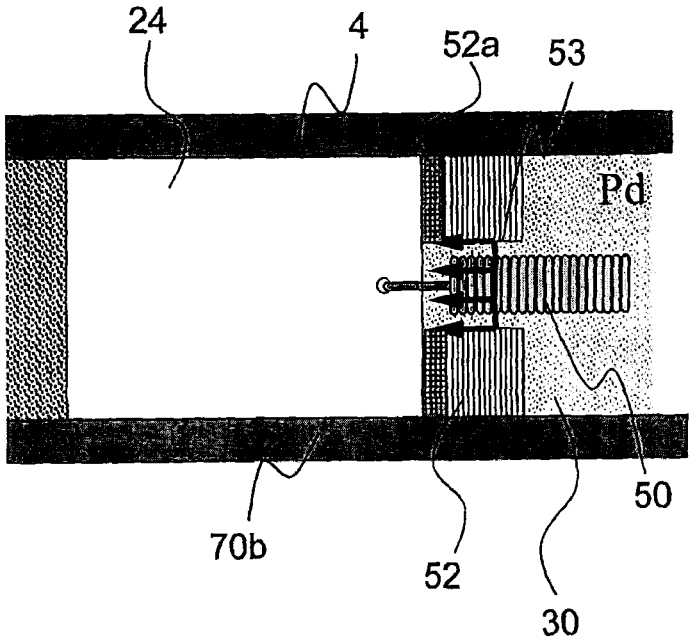

FIGS. 13 and 14 are enlarged views of a main portion illustrating the vicinity of a second vane 24 of a second compression mechanism part 20 of a multi-cylinder rotary compressor 100 according to Embodiment 6 of the present invention. FIG. 13 illustrates the vicinity of the second vane 24 in a state in which the second compression mechanism part 20 performs a refrigerant compression operation, where (a) is a transverse sectional view illustrating the vicinity of the second vane 24 and (b) is a longitudinal sectional view illustrating the vicinity of the second vane 24. FIG. 14 illustrates the vicinity of the second vane 24 of the second compression mechanism part 20 in a cylinder cutoff state, where (a) is a transverse sectional view illustrating the vicinity of the second vane 24 and (b) is a longitudinal sectional view illustrating the vicinity of the second vane 24.

As illustrated in FIGS. 13 and 14, a contact portion 52 according to Embodiment 6 includes an elastic member 52*a* (cushion material) such as rubber and silicone in a flat surface of the contact portion 52 facing a rear end 24*b* of the second vane 24.

The configuration of the contact portion 52 of Embodiment 6 enables a shift allowance of the degree of parallelism between the contact portion 52 and the rear end 24*b* of the second vane 24 to be larger than that in the case of using a contact portion 52 including no elastic member 52*a*. Thus, the configuration of the contact portion 52 as described in Embodiment 6 eases assembly of the multi-cylinder rotary compressor 100.

Embodiment 7

In a case where a retention mechanism includes a contact portion 52 having a communication hole 53, a rear end 24*b* of a second vane 24 may be formed in the following shape. Part of the configuration not specifically described in Embodiment 7 is similar to that of one of Embodiments 1 to 6, and the same functions and components are denoted by the same reference signs.

Figure 15:
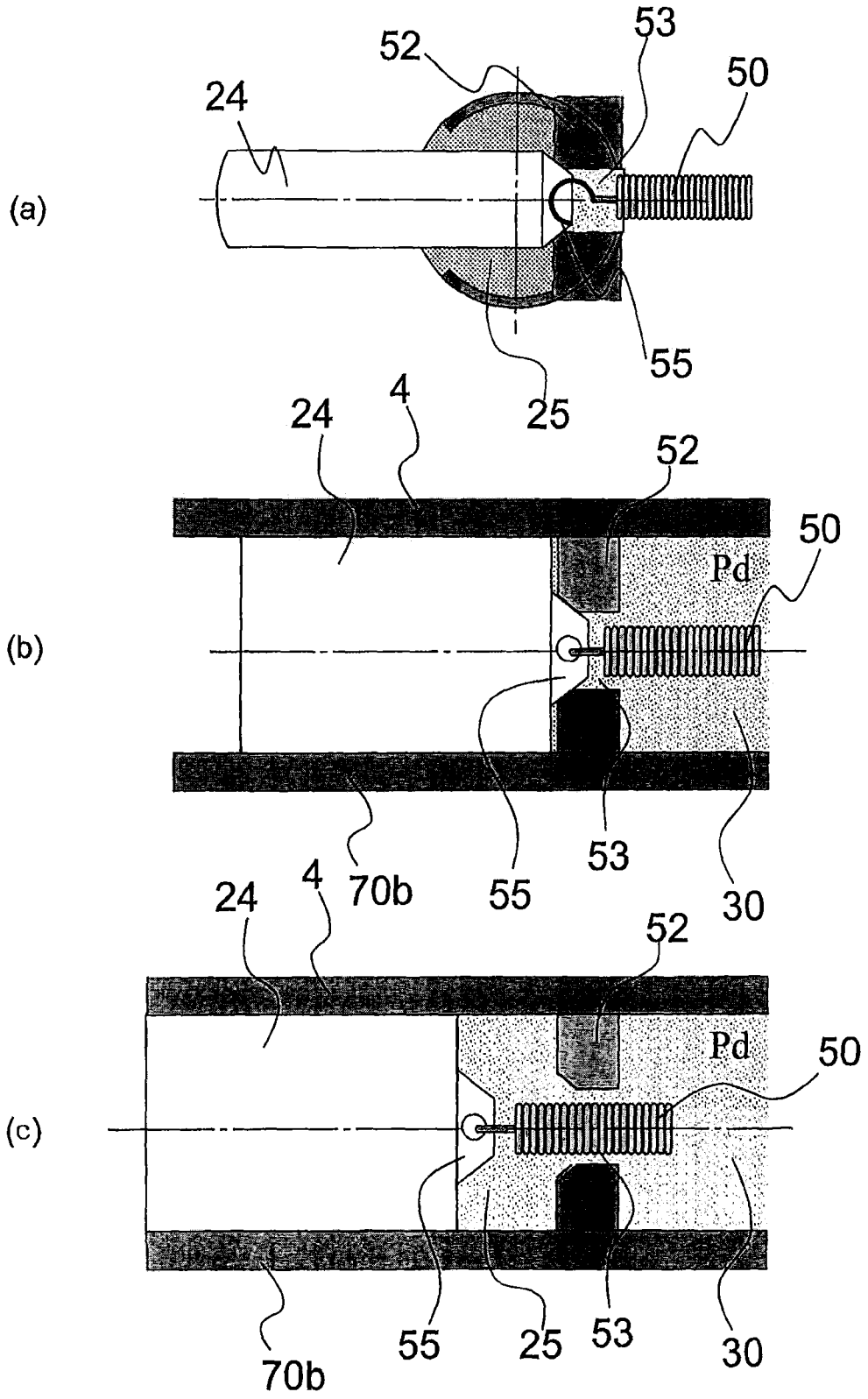
FIG. 15 shows enlarged views of a main portion illustrating an example of a second vane 24 of a multi-cylinder rotary compressor 100 according to Embodiment 7 of the present invention.

FIG. 15 shows enlarged views of a main portion illustrating an example of a second vane 24 of a multi-cylinder rotary compressor 100 according to Embodiment 7 of the present invention. FIG. 15 (*a*) is a transverse sectional view illustrating the vicinity of the second vane 24 of a second compression mechanism part 20 in a cylinder cutoff state. FIG. 15 (*b*) is a longitudinal sectional view illustrating the vicinity of the second vane 24 of the second compression mechanism part 20 in the cylinder cutoff state. FIG. 15 (*c*) is a longitudinal sectional view illustrating the vicinity of the second vane 24 of the second compression mechanism part 20 in a refrigerant compression operation.

Figure 16:
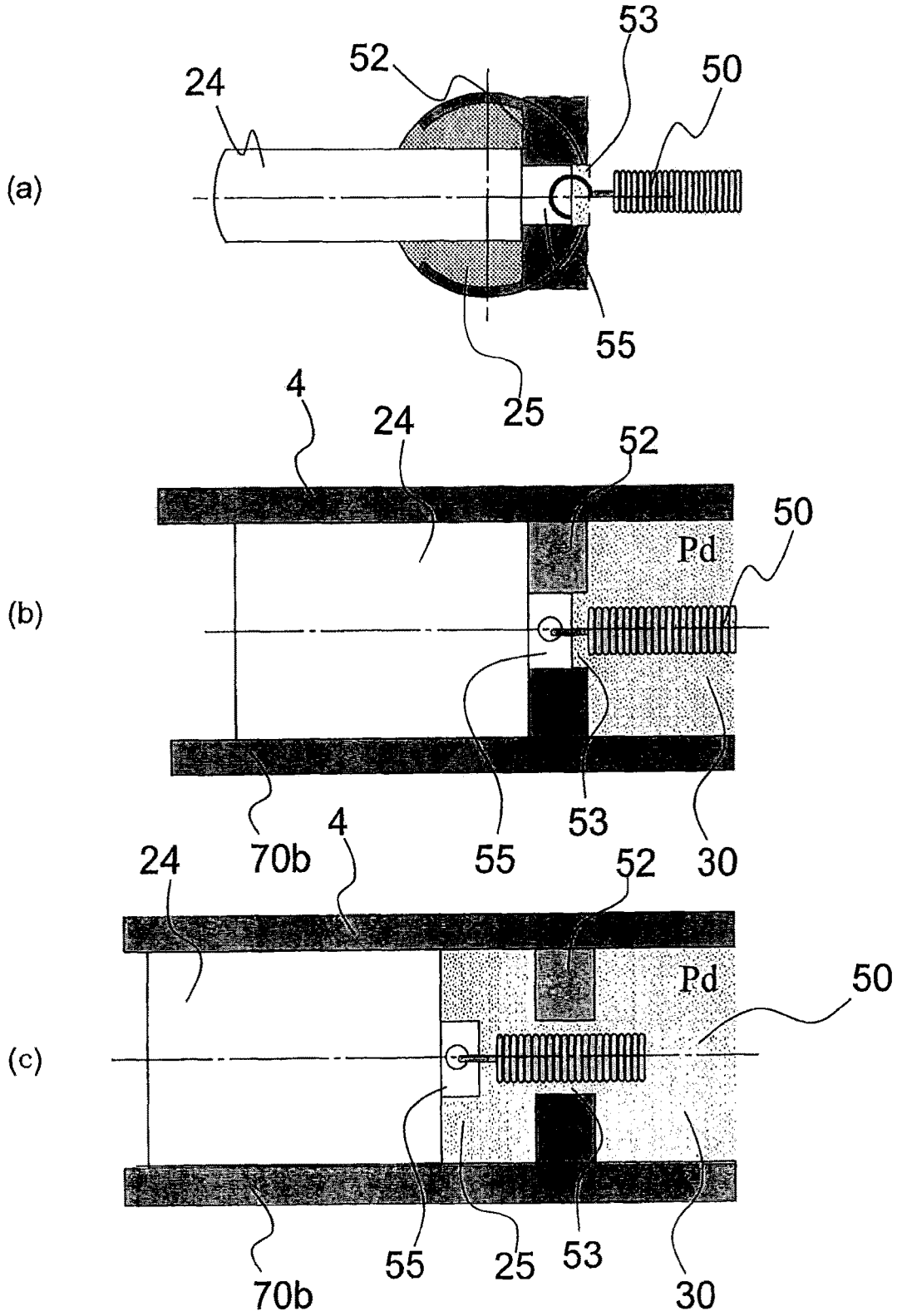
FIG. 16 shows enlarged views of a main portion illustrating another example of the second vane 24 of the multi-cylinder rotary compressor 100 according to Embodiment 7 of the present invention.

FIG. 16 shows enlarged views of a main portion illustrating another example of the second vane 24 of the multi-cylinder rotary compressor 100 according to Embodiment 7 of the present invention. FIG. 16 (*a*) is a transverse sectional view illustrating the vicinity of the second vane 24 of a second compression mechanism part 20 in a cylinder cutoff state. FIG. 16 (*b*) is a longitudinal sectional view illustrating the vicinity of the second vane 24 of the second compression mechanism part 20 in the cylinder cutoff state. FIG. 16 (*c*) is a longitudinal sectional view illustrating the vicinity of the second vane 24 of the second compression mechanism part 20 in a refrigerant compression operation.

For example, as illustrated in FIGS. 15 and 16, the second vane 24 of the multi-cylinder rotary compressor 100 according to Embodiment 7 has a rear end 24*b* in which a cylindrical, conical, prismatic, or pyramidal protrusion 55 (corresponding to a projecting portion of present invention) is formed. A communication hole 53 (corresponding to a recessed portion of the present invention) in a contact portion 52 has a shape corresponding to the protrusion 55 of the second vane 24. When the protrusion 55 of the second vane 24 is fitted in (comes into contact with) the communication hole 53 in the contact portion 52, sealing is obtained at the contact surface therebetween.

In Embodiment 7, upper and lower openings of the vane rear chamber 25 are closed with an intermediate partition plate 4 and a flange portion 70*b* of a second support member 70.

As described above, in a manner similar to Embodiments 1 to 6, in the multi-cylinder rotary compressor 100 having the configuration as described in Embodiment 7 can allow the second compression mechanism part 20 to switch to the cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In a manner similar to Embodiments 1 to 6, the multi-cylinder rotary compressor 100 according to Embodiment 7 can stably retain the location of the second vane 24 when the second vane 24 moves to be separated from the outer peripheral wall of the second piston 23.

In the multi-cylinder rotary compressor 100 according to Embodiment 7, when the protrusion 55 of the second vane 24 is fitted in the communication hole 53 of the contact portion 52, a large pressure loss occurs at the inlet/outlet of the communication hole 53. Thus, an area of the rear end 24*b* of the second vane 24 to which a discharge pressure is applied can be reduced, thereby allowing the second vane 24 to come into contact with the contact portion 52 more easily (achieving more stable retention).

Embodiment 8

In a case where the contact portion 52 is composed of a magnet (magnet 54), the magnet 54 may be an electromagnet.

In a manner similar to Embodiments 1 to 7, in the multi-cylinder rotary compressor 100 having the configuration described above can allow a second compression mechanism part 20 to switch to a cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In addition, in a manner similar to Embodiments 1 to 7, the multi-cylinder rotary compressor 100 according to Embodiment 8 can stably retain the location of a second vane 24 when the second vane 24 moves to be separated from an outer peripheral wall of a second piston 23.

Since the magnet 54 is composed of the electromagnet in the multi-cylinder rotary compressor 100 according to Embodiment 8, electric wiring needs to be additionally provided. However, a magnetic force can be generated only when necessary by supplying power to the magnet, and thus, the second compression mechanism part 20 can freely switch to the cylinder cutoff state.

Embodiment 9

In a case where a drawing force by a spring is applied to the second vane 24, the drawing force may be applied to the second vane 24 without the use of a tension spring 50, and the configuration may be as follows. Part of the configuration not specifically described in Embodiment 9 is similar to that of one of Embodiments 1 to 4 and 6 to 8, and the same functions and components are denoted by the same reference signs.

Figure 17:
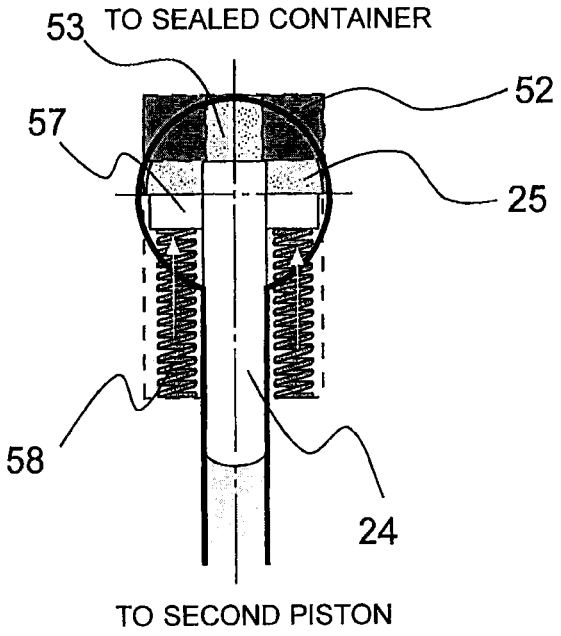
FIG. 17 is a transverse sectional view illustrating the vicinity of a second vane 24 of a second compression mechanism part 20 of a multi-cylinder rotary compressor 100 according to Embodiment 9 of the present invention.

FIG. 17 is a transverse sectional view illustrating the vicinity of a second vane 24 of a second compression mechanism part 20 of a multi-cylinder rotary compressor 100 according to Embodiment 9 of the present invention.

As illustrated in FIG. 17, a pair of vane sideplates 57 is disposed on side surfaces of the second vane 24 according to Embodiment 9 at such a location where the vane sideplates 57 are disposed in a vane rear chamber 25. A pair of compression springs 58 are disposed at a location radially inside of a second cylinder chamber 22 (on the side of a second piston 23) relative to the vane sideplates 57. In the multi-cylinder rotary compressor 100 according to Embodiment 9, the pair of vane sideplates 57 are pressed by the pair of compression springs 58 radially outside of the second cylinder chamber 22 (in such a direction that the second vane 24 moves away from the second piston 23). That is, a drawing force by the pair of compression springs 58 is applied to the second vane 24.

As described above, in a manner similar to Embodiments 1 to 4 and 6 to 8, in the multi-cylinder rotary compressor 100 having the configuration as described in Embodiment 9 can allow the second compression mechanism part 20 to switch to the cylinder cutoff state without the need for a mechanical capacity controlling unit including, for example, a shut-off valve, a switching valve, and a pipe, required by the multi-cylinder rotary compressor of Patent Literature 1. Thus, increase in size and costs of the multi-cylinder rotary compressor 100 can be prevented, and energy saving performance in an actual load operation can be enhanced. In a manner similar to Embodiments 1 to 4 and 6 to 8, the multi-cylinder rotary compressor 100 according to Embodiment 9 can stably retain the location of the second vane 24 when the second vane 24 moves to be separated from the outer peripheral wall of the second piston 23.

Embodiment 10

In the case of using a magnet 54 as a contact portion 52, the magnet 54 may have the following shape. Part of the configuration not specifically described in Embodiment 10 is similar to that of one of Embodiments 1 to 9, and the same functions and components are denoted by the same reference signs.

Figure 18:
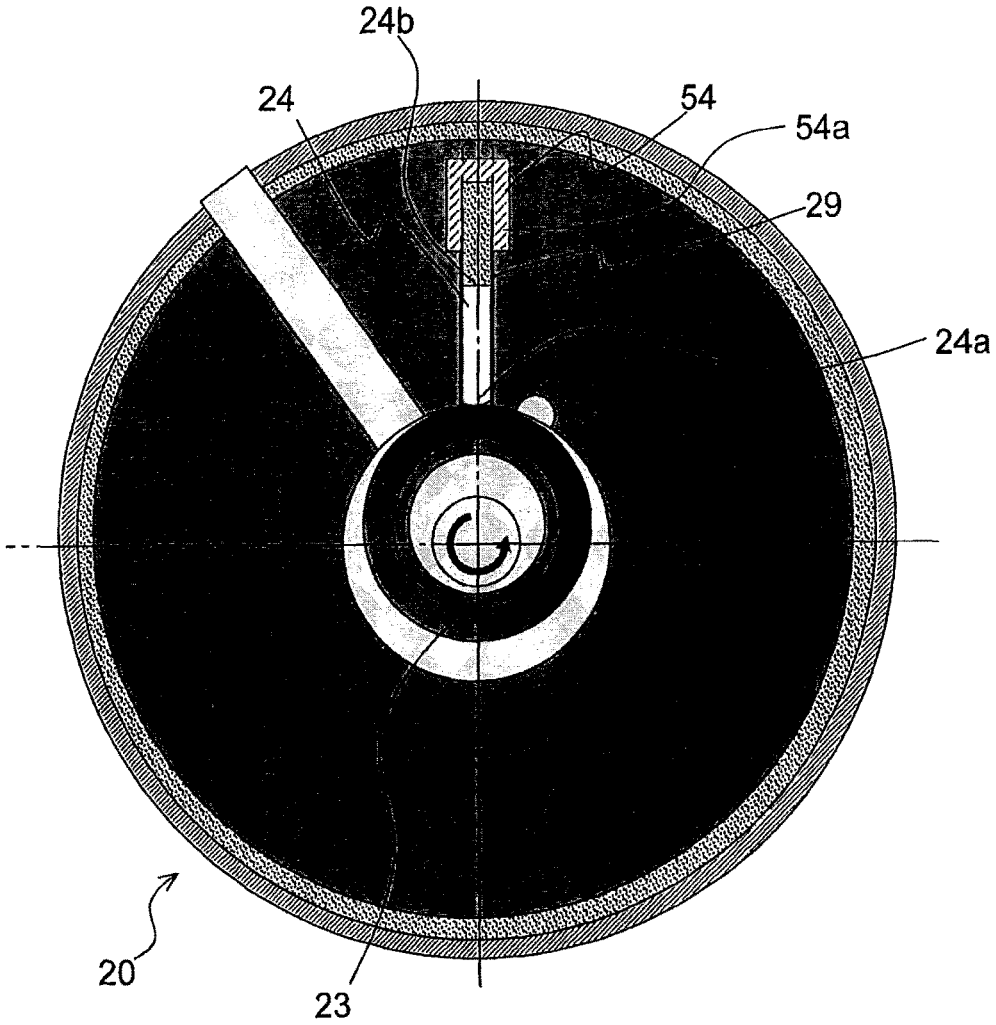
FIG. 18 is a transverse sectional view illustrating a second compression mechanism part 20 of a multi-cylinder rotary compressor 100 according to Embodiment 10 of the present invention.

FIG. 18 is a transverse sectional view illustrating a second compression mechanism part 20 of a multi-cylinder rotary compressor 100 according to Embodiment 10 of the present invention.

As illustrated in FIG. 18, a magnet 54 of the multi-cylinder rotary compressor 100 according to Embodiment 10 has a pair of projecting portions 54*a* projecting toward a second vane 24. The opposed surfaces of the projecting portions 54*a* are flat and located at substantially the same positions as side surfaces of the vane groove 29. In other words, the opposed surfaces of the pair of projecting portions 54*a* also serve as the side surfaces of the vane groove 29. That is, the projecting portions 54*a* are disposed in such a manner that the second vane 24 comes to be sandwiched between the pair of projecting portions 54*a* when the second vane 24 moves away from a second piston 23.

As described with reference to FIG. 10, a magnetic force of the magnet 54 applied to the second vane 24 is at the maximum when the second vane 24 is in contact with the magnet 54, attenuates as the second vane 24 moves away from the magnet 54, and reaches a negligible degree when the second vane 24 is away from the magnet 54 at a certain distance or more. That is, in a state in which a front end 24*a* of the second vane 24 is pressed against an outer peripheral wall of the second piston 23 so that the second compression mechanism part 20 compresses refrigerant, the second vane 24 is separated from the magnet 54 at a certain distance or more. A magnetic force of the magnet 54 is hardly applied to the second vane 24.

On the other hand, when a pressure (discharge pressure) of an internal space 7 of a sealed container 3 decreases, the second vane 24 moves away from the outer peripheral wall of the second piston 23, and the second compression mechanism part 20 switches to a cylinder cutoff state. When the second vane 24 then moves further away from the outer peripheral wall of the second piston 23, a drawing force due to the magnetic force of the magnet 54 is applied to the second vane 24. Thus, the difference between the pressing force and the drawing force applied to the second vane 24 increases to be distinct so that the second vane 24 moves further away from the outer peripheral wall of the second piston 23 to come into contact with the magnet 54.

At this time, since the magnet 54 according to Embodiment 10 has the pair of projecting portions 54*a* projecting toward the second vane 24, the magnetic force of the magnet 54 can be applied to the second vane 24 in a state where the distance between the second vane 24 and the magnet 54 is larger than that in the state where no projecting portions 54*a* are included. In addition, since the area where the second vane 24 faces the magnet 54 (the area to which the magnetic force is applied) increases, a larger magnetic force can be applied to the second vane 24. Thus, in the multi-cylinder rotary compressor 100 according to Embodiment 10, the second vane 24 can more easily come into contact with the magnet 54 than in the case of using the magnet 54 including no projecting portions 54*a*, and thus, the second vane 24 can be more stably retained.

Embodiment 11

The multi-cylinder rotary compressors 100 described in Embodiments 1 to 10 can be used for, for example, a vapor compression refrigeration cycle system as described below.

Figure 19:
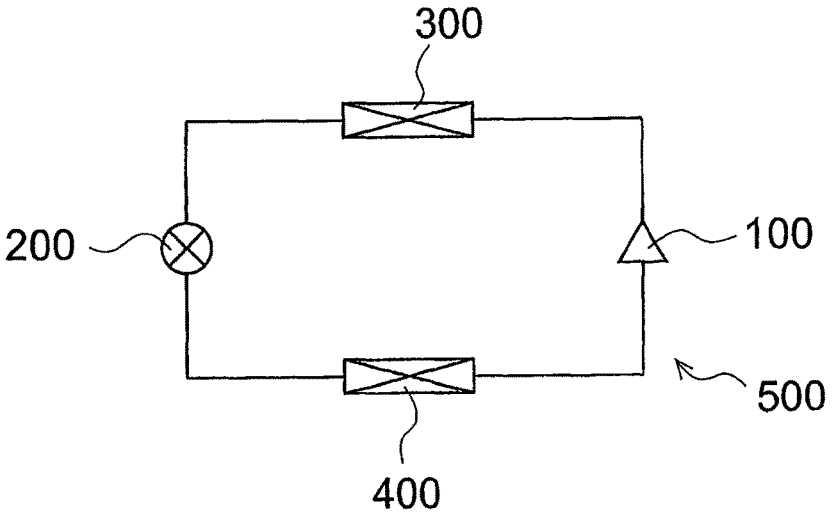
FIG. 19 is a view illustrating a vapor compression refrigeration cycle system 500 according to Embodiment 11 of the present invention.

FIG. 19 is a view illustrating a vapor compression refrigeration cycle system 500 according to Embodiment 11 of the present invention.

The vapor compression refrigeration cycle system 500 according to Embodiment 11 includes the multi-cylinder rotary compressor 100 of any one of Embodiments 1 to 10, a radiator 300 for transferring heat from refrigerant compressed in the multi-cylinder rotary compressor 100, an expansion mechanism 200 for expanding refrigerant from the radiator 300, and an evaporator 400 for causing refrigerant from the expansion mechanism 200 to absorb heat.

By including the multi-cylinder rotary compressor 100 of any one of Embodiments 1 to 10 as in the vapor compression refrigeration cycle system 500 according to Embodiment 11, increases in size and costs of the vapor compression refrigeration cycle system 500 can be prevented, and energy saving performance in an actual load operation can be enhanced.

Embodiment 12

In a case where a contact portion 52 is composed of a magnet 54, which is a permanent magnet, a multi-cylinder rotary compressor 100 may be configured as follows. Part of the configuration not specifically described in Embodiment 12 is similar to that of one of Embodiments 1 to 10, and the same functions and components are denoted by the same reference signs.

Figure 20:
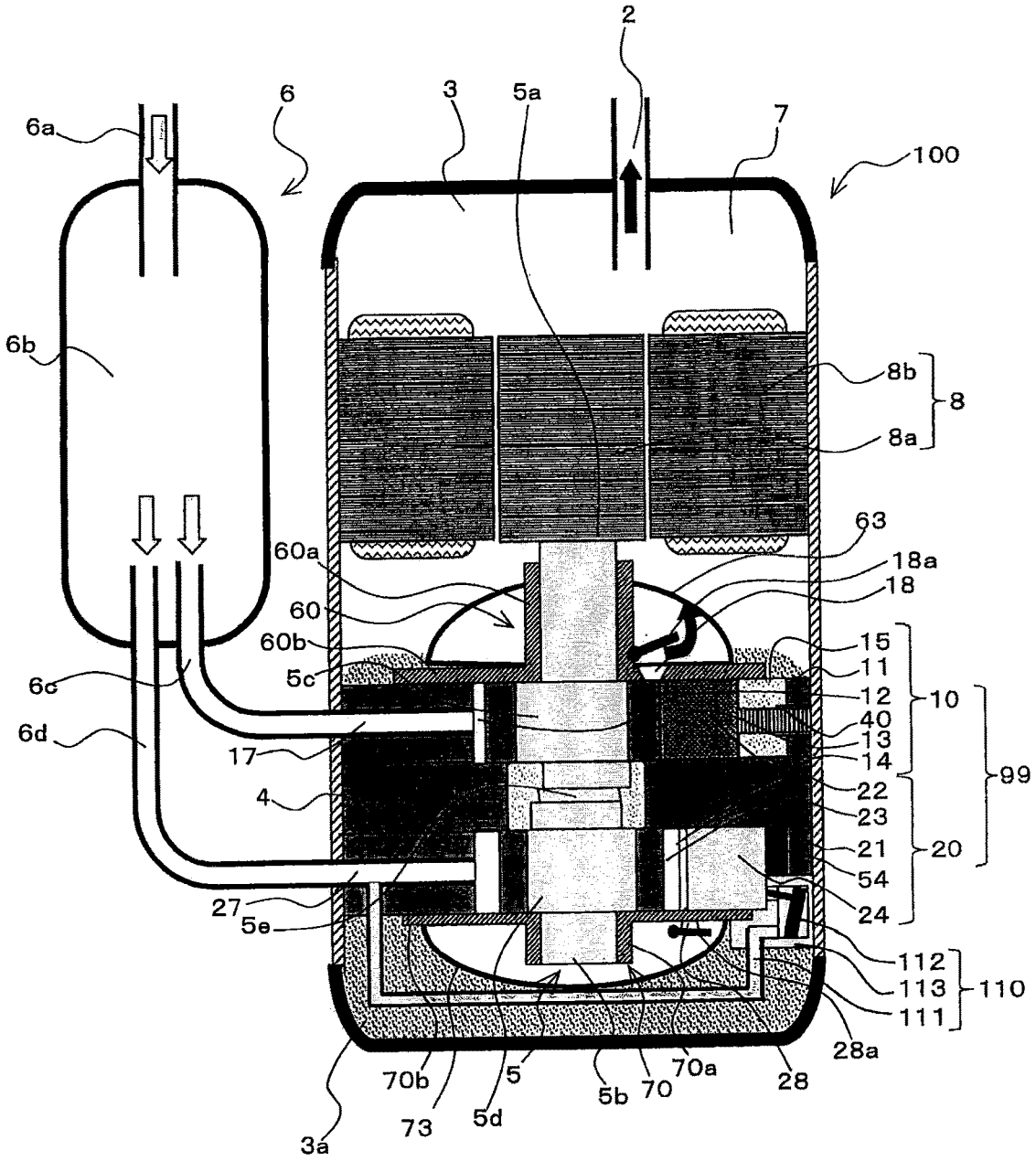
FIG. 20 is a longitudinal sectional view schematically illustrating a configuration of a multi-cylinder rotary compressor 100 according to Embodiment 12 of the present invention.
Figure 21:
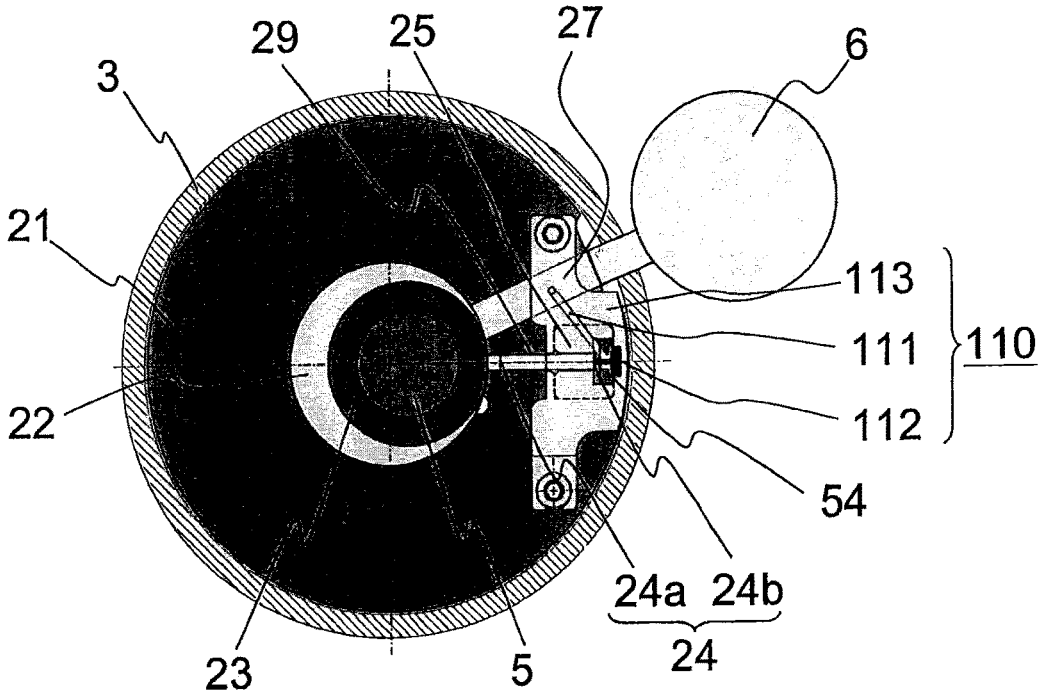
FIG. 21 is a transverse sectional view schematically illustrating a second compression mechanism part 20 of the multi-cylinder rotary compressor 100 according to Embodiment 12 of the present invention.
Figure 22:
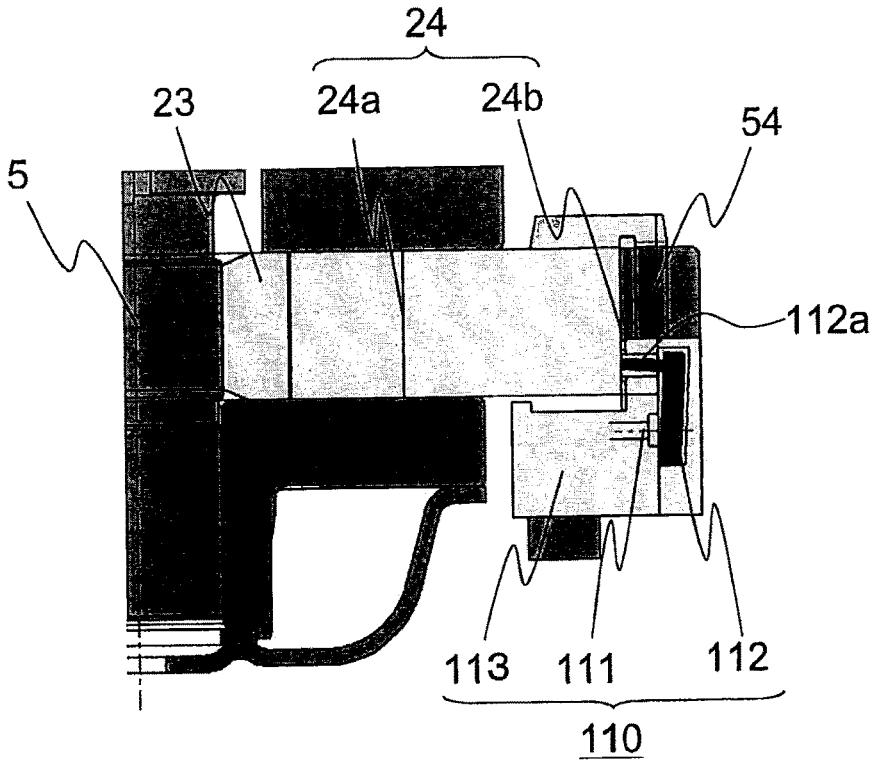
FIG. 22 is an enlarged view of a main portion illustrating the vicinity of a second vane 24 of the second compression mechanism part 20 of the multi-cylinder rotary compressor 100 according to Embodiment 12 of the present invention.

FIG. 20 is a longitudinal sectional view schematically illustrating a configuration of a multi-cylinder rotary compressor 100 according to Embodiment 12 of the present invention. FIG. 21 is a transverse sectional view schematically illustrating a second compression mechanism part 20 of the multi-cylinder rotary compressor 100. FIG. 22 is an enlarged view (longitudinal sectional view) of a main portion illustrating the vicinity of a second vane 24 of the second compression mechanism part 20 of the multi-cylinder rotary compressor 100.

[Basic Configuration]

A basic configuration of the multi-cylinder rotary compressor 100 according to Embodiment 12 is similar to the basic configurations of the multi-cylinder rotary compressors 100 described in Embodiments 1 to 10. Specifically, the multi-cylinder rotary compressor 100 according to Embodiment 12 includes a drive shaft 5 having eccentric-pin shaft portions 5*c* and 5*d*, an electric motor 8 for driving and rotating the drive shaft 5, first and second compression mechanism parts 10 and 20 (two compression mechanisms), and a sealed container 3 housing the electric motor 8, the first compression mechanism part 10, and the second compression mechanism part 20 and storing lubricating oil at the bottom thereof.

The first compression mechanism part 10 includes a first cylinder 11 including a first cylinder chamber 12 into which low-pressure refrigerant is sucked from a suction pressure space (a suction muffler 6 and a cylinder suction channel 17) and from which compressed high-pressure refrigerant is discharged to a discharge pressure space (into a sealed container 3), a ring-shaped first piston 13 slidably attached to the eccentric-pin shaft portion 5*c* of the drive shaft 5 and eccentrically rotatable in the first cylinder 11, a first vane 14 for partitioning the first cylinder chamber 12 into two spaces when a front end 14*a* of the first vane 14 is pressed against an outer peripheral surface of the first piston 13, a vane groove 19 housing the first vane 14 in such a manner that the first vane 14 can reciprocate and being open to the first cylinder 11, and a vane rear chamber 15 housing a rear end 14*b* of the first vane 14 and communicating with the first cylinder chamber 12. Similarly, the second compression mechanism part 20 includes a second cylinder 21 including a second cylinder chamber 22 into which low-pressure refrigerant is sucked from a suction pressure space (the suction muffler 6 and the cylinder suction channel 27) and from which compressed high-pressure refrigerant is discharged to a discharge pressure space (into the sealed container 3), a ring-shaped second piston 23 slidably attached to the eccentric-pin shaft portion 5*d* of the drive shaft 5 and eccentrically rotatable in the second cylinder 21, a second vane 24 partitioning the second cylinder chamber 22 into two spaces when a front end 24*a* of the second vane 24 is pressed against an outer peripheral surface of the second piston 23, a vane groove 29 housing the second vane 24 in such a manner that the second vane 24 can reciprocate and being open to the second cylinder 21, and a vane rear chamber 25 housing a rear end 24*b* of the second vane 24 and communicating with the second cylinder chamber 22.

The first cylinder chamber 12 and the second cylinder chamber 22 always communicate with the suction pressure space. The vane rear chambers 15 and 25 always communicate with the discharge pressure space. A suction pressure and a discharge pressure are respectively applied to the front ends 14*a* and 24*a* and the rear ends 14*b* and 24*b* of the first vane 14 and the second vane 24. A force is applied to the first vane 14 and the second vane 24 in such a direction that the first vane 14 and the second vane 24 come into contact with the first piston 13 and the second piston 23 in accordance with the difference between the pressure applied to the front ends 14*a* and 24*a* and the pressure applied to the rear ends 14*b* and 24*b*. A force applied in this contact direction will be referred to as a first force.

A compression spring 40 is provided in the vane rear chamber 15 of the first compression mechanism part 10, and a force is applied in such a direction that the first vane 14 comes into contact with the first piston 13. The first force is applied even when no such pressure difference occurs.

[Characteristic Configuration of Embodiment 12]

The multi-cylinder rotary compressor 100 according to Embodiment 12 has the following characteristic configuration.

The vane rear chamber 25 of the second compression mechanism part 20 includes, as a contact portion 52, a magnet 54, which is a permanent magnet. The multi-cylinder rotary compressor 100 according to Embodiment 12 includes a low-pressure introduction mechanism 110 for introducing low-pressure refrigerant from a suction pressure space into, for example, part of a space on the side of the rear end 24*b* of the second vane 24 in a state in which the second vane 24 is separated from the second piston 23 (more specifically, the second vane 24 is attracted by the magnet 54). The low-pressure introduction mechanism 110 includes a channel 111 for causing the suction pressure space (more specifically a cylinder suction channel 27) to communicate with a space on the side of the rear end 24*b* of the second vane 24 and a sealer 112 for opening and closing the channel 111. The sealer 112 is disposed at an inlet of the channel 111 on the side of the rear end 24*b* of the second vane 24 and is biased to close the channel 111. When the second vane 24 comes into contact with the sealer 112 (more specifically a projection 112*a* projecting toward the second vane 24), the sealer 112 opens the channel 111 so that low-pressure refrigerant is introduced from the suction pressure space to, for example, part of a space on the side of the rear end 24*b* of the second vane 24. The channel 111 and the sealer 112 are provided in the non-magnetic retention member 113, together with the magnet 54, which is a permanent magnet.

The magnet 54, which is a permanent magnet, applies a magnetic suction force to the second vane 24 in a direction away from the second piston 23. As illustrated in FIG. 10, this magnetic suction force increases as the second vane 24 approaches the magnet 54. In the following description, a force applied in such a direction that the second vane 24 moves away from the second piston 23 will be referred to as a second force.

Specifically, the first force and the second force are always applied to the second vane 24, and the second compression mechanism part 20 autonomously switches between a compressed state in which the front end 24*a* of the second vane 24 is in contact with the second piston 23 and a cylinder cutoff state (uncompressed state) in which the front end 24*a* of the second vane 24 is separated from the second piston 23, depending on the magnitude correlation between the first force and the second force. In other words, when the first force is greater than the second force, the second compression mechanism part 20 switches to the compressed state, and when the second force is greater than the first force, the second vane 24 is separated from the second piston 23 so that the second cylinder chamber 22 is in a cylinder cutoff state in which no compression chamber is formed. When the second vane 24 is once separated from the second piston 23, the second vane 24 approaches the magnet 54, and the second force applied to the second vane 24 increases because of characteristics of the permanent magnet described with reference to FIG. 10.

To switch the second compression mechanism part 20 to the compressed state again, it is required that the first force is greater than the second force. A second force obtained when the second vane 24 is attracted by the magnet 54 is larger than a second force obtained when the second vane 24 is separated from the second piston 23. Thus, a first force obtained when the second compression mechanism part 20 switches from the uncompressed state to the compressed state is larger than a first force obtained when the second compression mechanism part 20 switches from the compressed state to the cylinder cutoff state.

[Operation of Second Compression Mechanism Part]

Figure 23:
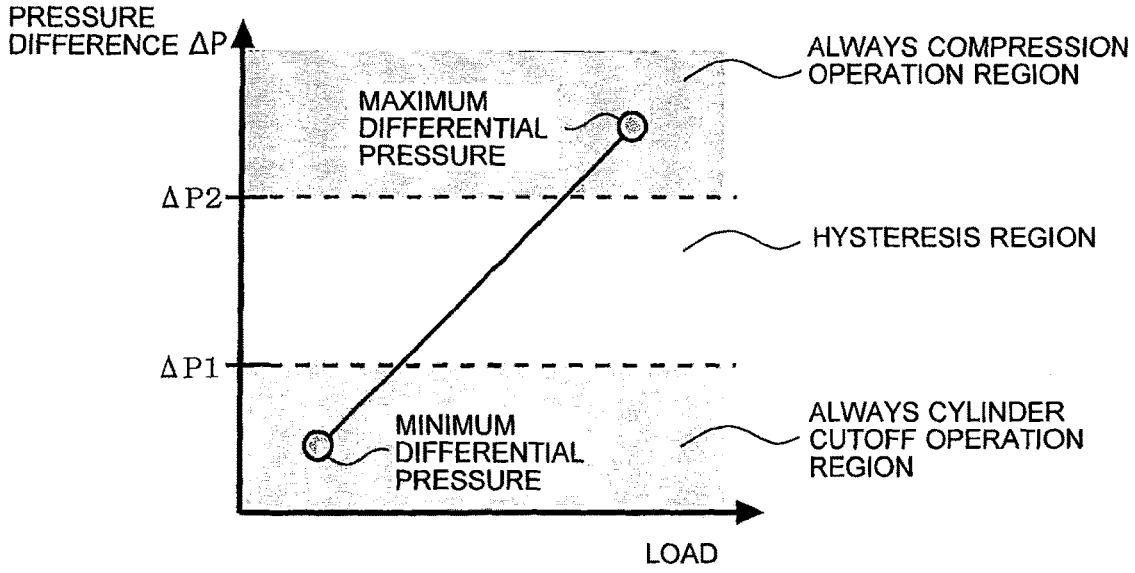
FIG. 23 shows a relationship between an operating state and a pressure difference $\Delta P$ between pressures applied to a front end 24*a* and a rear end 24*b* of the second vane 24 in the second compression mechanism part 20 according to Embodiment 12 of the present invention.

FIG. 23 shows a relationship between an operating state and a pressure difference ΔP between pressures applied to the front end 24*a* and the rear end 24*b* of the second vane 24 in the second compression mechanism part 20 according to Embodiment 12 of the present invention. In FIG. 23, the ordinate represents the pressure difference ΔP, and the abscissa represents a load on the multi-cylinder rotary compressor 100.

In a region less than or equal to a pressure difference ΔP1 at which the second compression mechanism part 20 switches from a compressed state to a cylinder cutoff state, the relationship of first force<second force is always established, and the second vane 24 is in the cylinder cutoff state in which the second vane 24 is always separated from the second piston 23. This region will be hereinafter referred to as an always cylinder cutoff operation region.

In a region greater than or equal to a pressure difference ΔP2 at which the second compression mechanism part 20 switches from the cylinder cutoff state to the compressed state, the relationship of first force>second force is always established, and the second compression mechanism part 20 is in the compressed state. This region will be hereinafter referred to as an always compression operation region.

A region between the two regions described above is a region in which any one of the compressed state and the cylinder cutoff state can be selected. This region will be hereinafter referred to as a hysteresis region.

Figure 24:
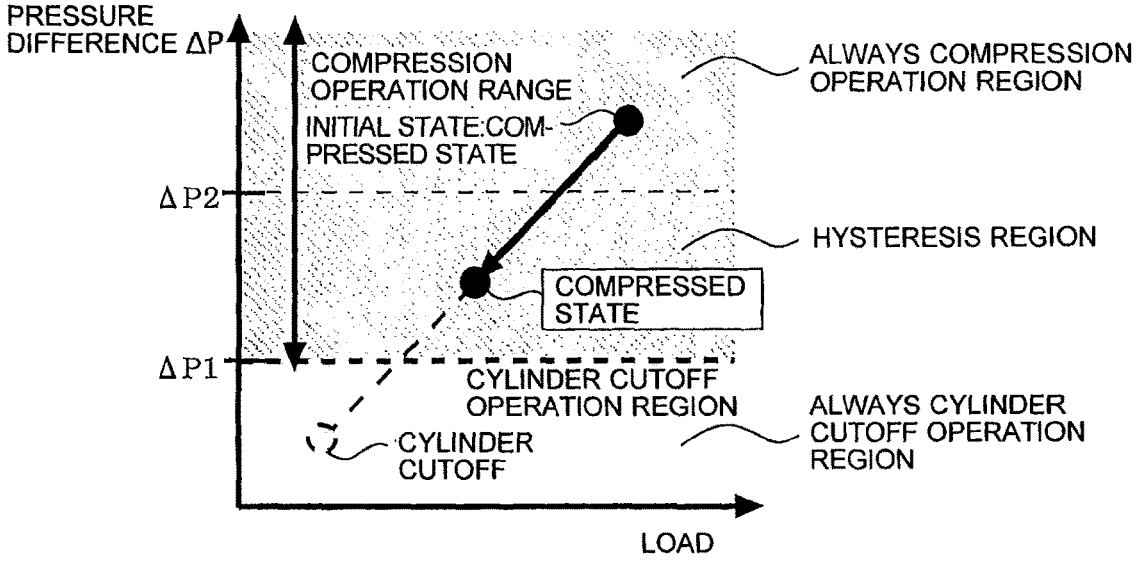
FIG. 24 shows an operating state when the second compression mechanism part 20 according to Embodiment 12 of the present invention has switched from an always compression operation region to a hysteresis region.

FIG. 24 shows an operating state when the second compression mechanism part 20 according to Embodiment 12 of the present invention has switched from the always compression operation region to the hysteresis region.

The second vane 24 is brought into contact with the second piston 23 by temporarily increasing the pressure difference ΔP to the always compression operation region, and then the second compression mechanism part 20 is switched to the compressed state in the hysteresis region (becomes able to perform a compression operation) by reducing the pressure difference ΔP to the hysteresis region.

Figure 25:
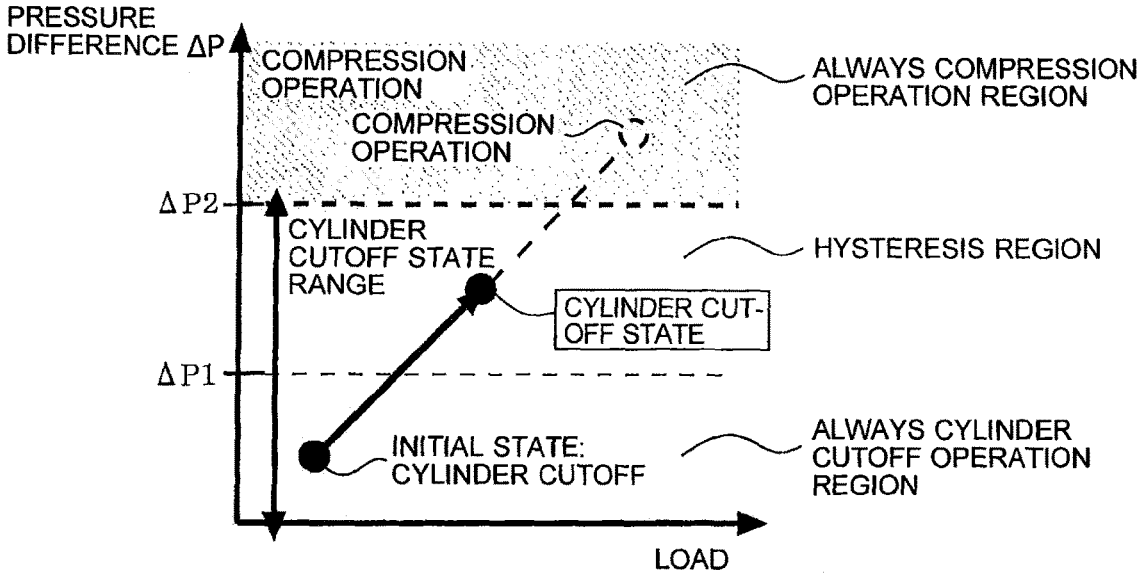
FIG. 25 shows an operating state when the second compression mechanism part 20 according to Embodiment 12 of the present invention has switched from the always cylinder cutoff operation region to the hysteresis region.

FIG. 25 shows an operating state when the second compression mechanism part 20 according to Embodiment 12 of the present invention has switched from the always cylinder cutoff operation region to the hysteresis region.

The second vane 24 is moved to be separated from the second piston 23 by temporarily reducing the pressure difference ΔP to the always cylinder cutoff operation region, and then the second compression mechanism part 20 is switched to the cylinder cutoff state in the hysteresis region by increasing the pressure difference ΔP to the hysteresis region.

The above-described operation in the hysteresis region can be obtained only by using characteristics of a permanent magnet. However, since the magnetic suction force tends to rapidly increase at a location close to a permanent magnet as shown in FIG. 10, there has been a problem that the magnetic suction force applied to the second vane 24 varies depending on a machining accuracy and an assembly accuracy of the contact surface of the magnet 54, which is a permanent magnet with the second vane 24.

[Operation of Low-Pressure Introduction Mechanism Part]

Figure 26:
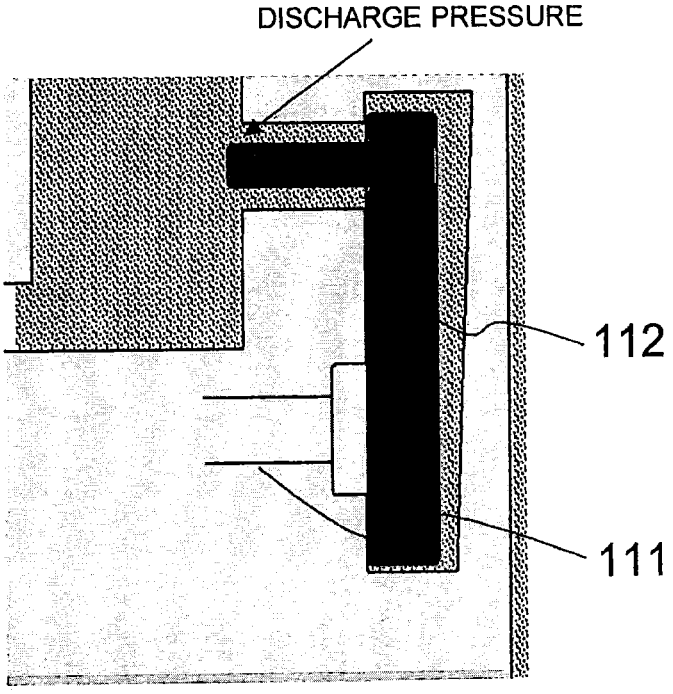
FIG. 26 shows longitudinal sectional views for describing operation of a sealer 112 of a low-pressure introduction mechanism 110 according to Embodiment 12 of the present invention.
Figure 26:
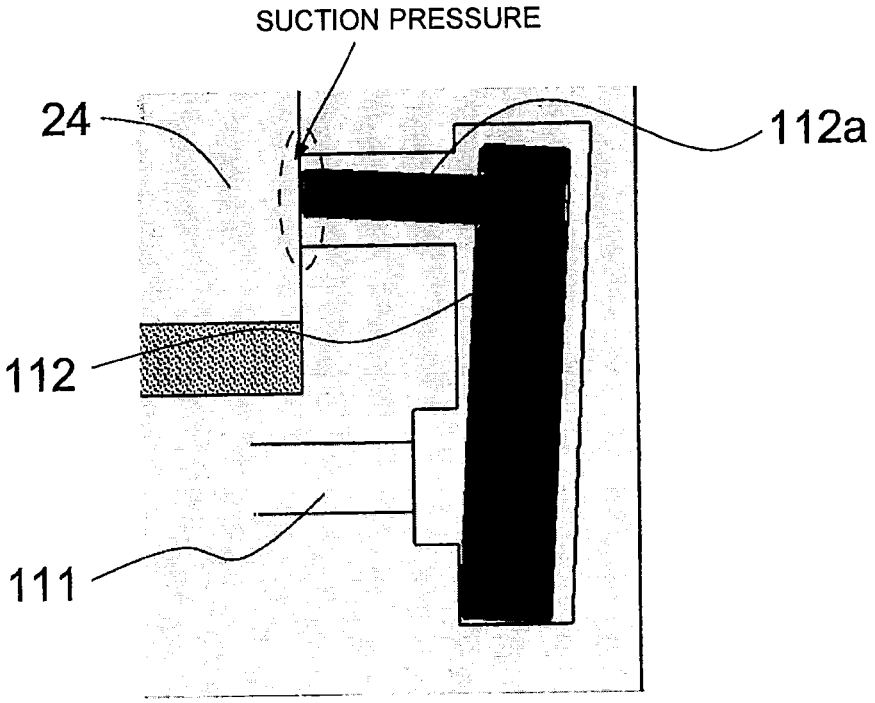

FIG. 26 shows longitudinal sectional views for describing operation of the sealer 112 of a low-pressure introduction mechanism 110 according to Embodiment 12 of the present invention. FIG. 26 (*a*) illustrates the vicinity of the sealer 112 when the second compression mechanism part 20 is in the compressed state. FIG. 26 (*b*) illustrates the vicinity of the sealer 112 when the second compression mechanism part 20 is in the cylinder cutoff state.

When the second vane 24 is attracted by the magnet 54, which is a permanent magnet, the projection 112*a* of the sealer 112 is pushed by the rear end 24*b* of the second vane 24 so that the sealer 112 is tilted. The tilt of the sealer 112 opens the channel 111 closed with the sealer 112 so that low-pressure refrigerant is supplied from a suction pressure space to, for example, part of a space on the side of the rear end 24*b* of the second vane 24. When a low pressure is supplied to the space on the side of the rear end 24*b* of the second vane 24, the area of the rear end 24*b* of the second vane 24 to which a discharge pressure is applied decreases, and thus, a first force due to the pressure difference ΔP applied to the second vane 24 decreases.

Consequently, a difference in first force occurs between before and after attraction of the second vane 24 by the magnet 54, which is a permanent magnet, as shown in FIG. 6, and the second vane 24 is retained stably.

That is, the introduction of a low pressure to the space on the side of the rear end 24*b* of the second vane 24 can reduce the first force and also reduce the attracting magnetic force equivalent to the first force. By reducing the attracting magnetic force, a sufficient attracting magnetic force can also be obtained in a region where the attracting magnetic force gently changes. Thus, a variation in switching operation can be reduced without an increase in size of the permanent magnet.

[Advantages]

The second compression mechanism part 20 of the multi-cylinder rotary compressor 100 described in each of Embodiments 1 to 10 has a configuration showing hysteresis of the first force or the second force between before and after attraction of the second vane 24, and can autonomously switch between the compressed state and the uncompressed state (cylinder cutoff state) by using a hysteresis effect in any case, but has the problem of a variation in the pressure difference ΔP during the switching. On the other hand, in the configuration of the multi-cylinder rotary compressor 100 as described in Embodiment 12, both the first force and the second force show hysteresis, and the necessary second force is smaller than that in a case where one of the first force or the second force shows hysteresis. Thus, the multi-cylinder rotary compressor 100 can be used in a region where the second force gently varies, and a stable operation can be achieved with a small variation of the pressure difference ΔP in autonomously switching between the compressed state and the uncompressed state (cylinder cutoff state).

The communication holes 51*a* and 51*b* described in, for example, Embodiment 1 are used for introducing low-pressure refrigerant from a suction pressure space to, for example, part of the space on the side of the rear end 24*b* of the second vane 24 in a state in which the second vane 24 is separated from the second piston 23 (specifically, the second vane 24 is attracted by the magnet 54). Thus, instead of or in addition to the channel 111, the communication holes 51*a* and 51*b* may be included as components of the low-pressure introduction mechanism 110. In this case, the communication hole 51*b* corresponds to the first channel of the present invention, and the communication hole 51*a* corresponds to the second channel of the present invention.

In the multi-cylinder rotary compressor 100 according to the Embodiment 12, a tension spring may be provided at the rear end 24*b* of the second vane 24, as described in, for example, Embodiment 1. Specifically, an inertial force F1 applied to the second vane 24 can be defined as $F1=mr\omega^2$ [N], where m [kg] is a weight of the second vane 24, r [m] is an inradius of the second cylinder 21 (i.e., the radius of the second cylinder chamber 22), and ω [rad/sec] is an angular velocity of the electric motor 8. Alternatively, the second force may be greater than the inertial force F1 when the second compression mechanism part 20 switches from the compressed state to the uncompressed state. In this manner, the time of switching of the second compression mechanism part 20 from the compressed state to the uncompressed state can be easily adjusted.

Embodiment 13

The low-pressure introduction mechanism 110 described in Embodiment 12 may be configured as follows. Part of the configuration not specifically described in Embodiment 13 is similar to that of Embodiment 12, and the same functions and components are denoted by the same reference signs.

Figure 27:
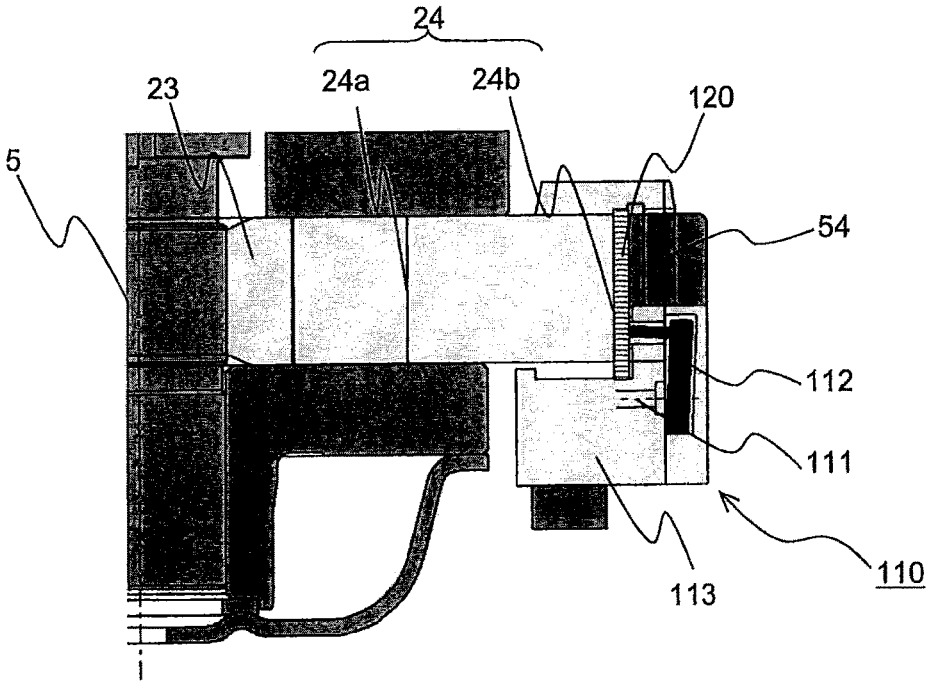
FIG. 27 is a longitudinal sectional view illustrating the vicinity of a low-pressure introduction mechanism 110 of a multi-cylinder rotary compressor 100 according to Embodiment 13 of the present invention.

FIG. 27 is a longitudinal sectional view illustrating the vicinity of a low-pressure introduction mechanism 110 of a multi-cylinder rotary compressor 100 according to Embodiment 13 of the present invention.

As compared to Embodiment 12, the multi-cylinder rotary compressor 100 according to Embodiment 13 includes a spacer 120 made of a non-magnetic material and disposed between a magnet 54 and a rear end 24*b* of a second vane 24. In this manner, a space can be formed between the second vane 24 and the magnet 54 when the second vane 24 is attracted by the magnet 54 to prevent the magnet 54 from coming into direct contact with the rear end 24*b* of the second vane 24.

Figure 28:
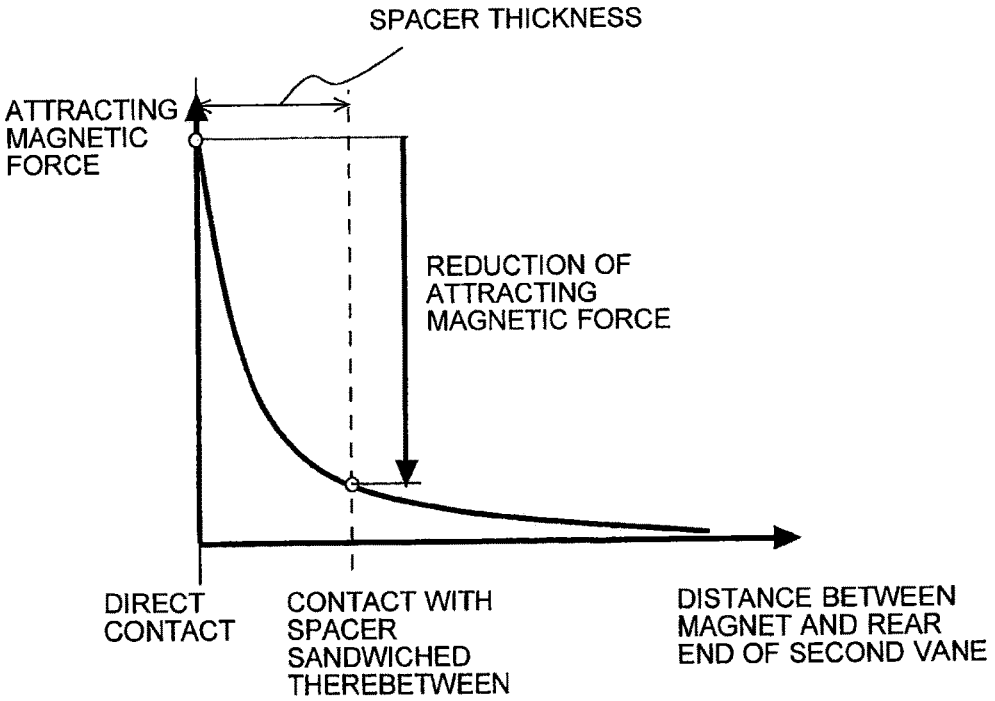
FIG. 28 is a view for describing relationship between a distance between a magnet 54 and the second vane 24 and a magnetic force applied to a second vane 24 in the multi-cylinder rotary compressor 100 according to Embodiment 13 of the present invention.

FIG. 28 is a view for describing a relationship between a distance between the magnet 54 and the second vane 24 and a magnetic force applied to the second vane 24 in the multi-cylinder rotary compressor 100 according to Embodiment 13 of the present invention.

Figure 29:
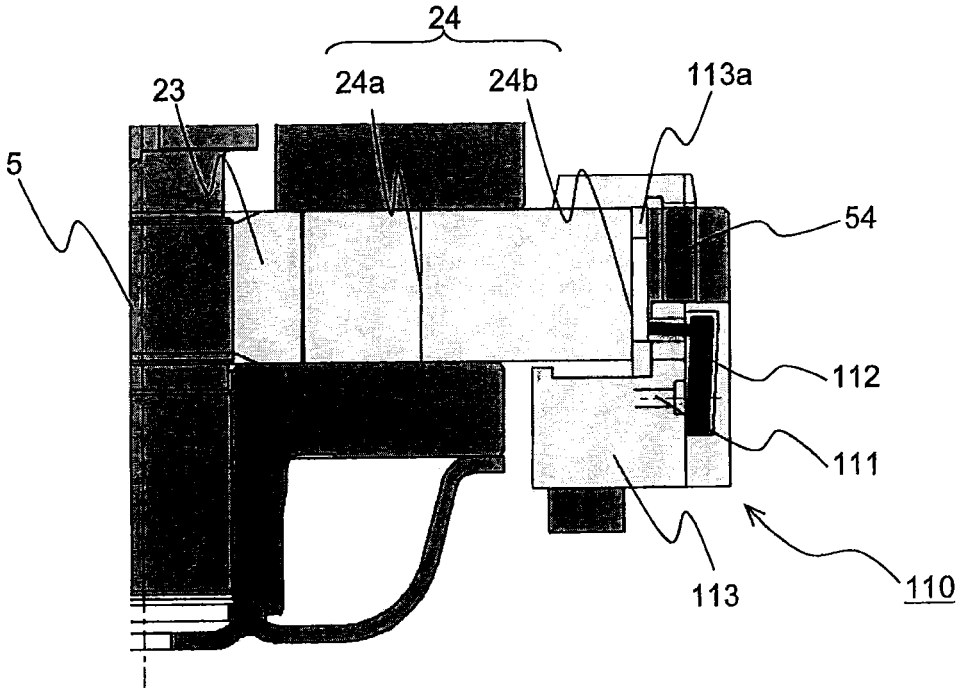
FIG. 29 is a longitudinal sectional view illustrating another example of the low-pressure introduction mechanism 110 of the multi-cylinder rotary compressor 100 according to Embodiment 13 of the present invention.

An attracting magnetic force in the case of forming a space between the magnet 54 and the rear end 24*b* of the second vane 24 is smaller than that in the case of directly attaching by attraction, and can be controlled depending on the thickness of the spacer 120. The control of the attracting magnetic force eases a design change of the pressure difference ΔP in switching from an uncompressed state to a compressed state. As illustrated in FIG. 29, a contact portion 113*a* may be provided in the non-magnetic retention member 113. In this case, similar advantages can be obtained.

The multi-cylinder rotary compressors 100 according to Embodiments 12 and 13 may be, of course, used for the vapor compression refrigeration cycle system 500 according to Embodiment 11. In this case, advantages similar to those obtained in Embodiment 11 can be obtained.

REFERENCE SIGNS LIST

2 compressor discharge pipe 3 sealed container 3*a* lubricating oil storage unit 4 intermediate partition plate 5 drive shaft 5*a* longer shaft portion 5*b* shorter shaft portion 5*c* eccentric-pin shaft portion 5*d* eccentric-pin shaft portion 5*e* intermediate shaft portion 6 suction muffler 6*a* inlet pipe

6*b* container 6*c*, 6*d* outlet pipe 7 internal space 8 electric motor 8*a* rotor 8*b* stator 10 first compression mechanism part (upper part) 11 first cylinder 12 first cylinder chamber 12*a* suction chamber 12*b* compression chamber 13 first piston 14 first vane 14*a* front end

14*b* rear end 15 vane rear chamber 17 cylinder suction channel 18 discharge port 18*a* shut-off valve 19 vane groove 20 second compression mechanism part (lower part) 21 second cylinder 22 second cylinder chamber 23 second piston 24 second vane 24*a* front end 24*b* rear end 25 vane rear chamber 27 cylinder suction channel 28 discharge port 28*a* shut-off valve 29 vane groove 30 channel 40 compression spring 50 tension spring 51*a* communication hole 51*b* communication hole

52 contact portion 52*a* elastic member (cushion material) 53 communication hole 54 magnet 54*a* projecting portion 55 protrusion 56 friction member 56*a* sloped surface 57 vane sideplate 58 compression spring 60 first support member 60*a* bearing portion 60*b* flange portion 63 discharge muffler 70 second support member 70*a* bearing portion 70*b* flange portion 73 discharge muffler 99 compression mechanism 100 multi-cylinder rotary compressor 110 low-pressure introduction mechanism 111 channel 112 sealer 112*a* projection 113 non-magnetic retention member 113*a* contact portion 120 spacer

200 expansion mechanism 300 radiator 400 evaporator 500 vapor compression refrigeration cycle system

The invention claimed is:

1. A multi-cylinder rotary compressor comprising:

a drive shaft including a plurality of eccentric-pin shaft portions;

an electric motor configured to drive and rotate the drive shaft;

a plurality of compression mechanisms; and a sealed container housing the electric motor and the plurality of compression mechanisms and storing lubricating oil at a bottom thereof, each of the plurality of compression mechanisms including a cylinder having a cylinder chamber into which low-pressure refrigerant is sucked from a suction pressure space and from which compressed high-pressure refrigerant is discharged to a discharge pressure space, a ring-shaped piston slidably attached to each of the plurality of eccentric-pin shaft portions of the drive shaft and configured to eccentrically rotate in the cylinder chamber, a vane configured to separate the cylinder chamber into two spaces when a front end of the vane is pushed against an outer peripheral surface of the piston, a vane groove housing the vane in such a manner that the vane reciprocates therein and being open to the cylinder chamber, and a vane rear chamber housing a rear end of the vane and communicating with the cylinder chamber, one of the plurality of compression mechanisms being configured to switch to a compressed state in which the vane is in contact with the piston or an uncompressed state in which the vane is separated from the piston and retained, the cylinder chamber always communicating with the suction pressure space in each of the compressed state and the uncompressed state, the vane rear chamber always communicating with the discharge pressure space in each of the compressed state and the uncompressed state, each of the vanes being applied by a first force in such a direction that the vane approaches the piston caused by a pressure difference between a pressure applied to the front end of each of the vanes and a pressure applied to the rear end of each of the vanes, the plurality of compression mechanisms including a second compression mechanism part being a mechanism that includes a permanent magnet disposed in the vane rear chamber and applies a second force to the vane in such a direction that the vane moves away from the piston and switches between the compressed state and the uncompressed state depending on a magnitude correlation between the first force and the second force, the second force in switching from the compressed state to the uncompressed state being greater than an inertial force applied to the vane, the second compression mechanism part has a relationship of:

$$\Delta P2>\Delta P1,$$

where ΔP is the pressure difference between the pressure applied to the front end of the vane and the pressure applied to the rear end of the vane, ΔP1 is the pressure difference in switching from the compressed state to the uncompressed state, and ΔP2 is the pressure difference in switching from the uncompressed state to the compressed state, in the compressed state, the second compression mechanism part continues a compression operation when ΔP>ΔP1, and switches to the uncompressed state when ΔP≤ΔP1, in the uncompressed state, the second compression mechanism part remains in the uncompressed state when ΔP<ΔP2, and switches to the compressed state when ΔP≥ΔP2, and a region of ΔP1<ΔP<ΔP2 includes a region where the second compression mechanism part is switchable to any one of the compressed state or the uncompressed state.

2. The multi-cylinder rotary compressor of claim 1, wherein the second compression mechanism part has a configuration in which the second force in switching from the compressed state to the uncompressed state is greater than the inertial force applied to the vane and defined as:

$$F1=mr\omega^2[N],$$

where F1 is the inertial force applied to the vane, m [kg] is a weight of the vane, r [m] is an inradius of the cylinder, and ω [rad/sec] is an angular velocity of the electric motor.

3. The multi-cylinder rotary compressor of claim 1, wherein the second compression mechanism part includes a low-pressure introduction mechanism that introduces the low-pressure refrigerant to a space on a side of the rear end of the vane in a state in which the vane is separated from the piston.

4. The multi-cylinder rotary compressor of claim 3, wherein the low-pressure introduction mechanism includes a channel that allows a part of the rear end of the vane to communicate with the suction pressure space and a sealer for opening and closing the channel, in the compressed state, the channel is closed with the sealer and only a pressure of the discharge pressure space is applied to the space on the side of the rear end of the vane, and in the uncompressed state, the low-pressure refrigerant is introduced to the rear end of the vane.

5. The multi-cylinder rotary compressor of claim 4, wherein the channel allows a suction port of the cylinder to communicate with the space on the side of the rear end of the vane, and the sealer is disposed at an inlet of the channel on the side of the rear end of the vane, opens the channel when the sealer is in contact with the vane, and closes the channel when the sealer is not in contact with the vane.

6. The multi-cylinder rotary compressor of claim 4, wherein the channel includes a first channel that is disposed in the cylinder and allows a suction port of the cylinder to communicate with a side surface of the vane and a second channel that allows the side surface of the vane to communicate with the rear end of the vane.

7. The multi-cylinder rotary compressor of claim 1, wherein a tension spring is disposed at the rear end of the vane.

8. A vapor compression refrigeration cycle system comprising:

the multi-cylinder rotary compressor of claim 1;

a radiator configured to transfer heat from the refrigerant compressed in the multi-cylinder rotary compressor;

an expansion mechanism configured to expand the refrigerant flowing from the radiator; and an evaporator configured to cause the refrigerant flowing from the expansion mechanism to absorb heat.

9. A multi-cylinder rotary compressor comprising:

a drive shaft including a plurality of eccentric-pin shaft portions;

an electric motor configured to drive and rotate the drive shaft;

a plurality of compression mechanisms; and a sealed container housing the electric motor and the plurality of compression mechanisms and storing lubricating oil at a bottom thereof, each of the plurality of compression mechanisms including a cylinder having a cylinder chamber into which low-pressure refrigerant is sucked from a suction pressure space and from which compressed high-pressure refrigerant is discharged to a discharge pressure space, a ring-shaped piston slidably attached to each of the plurality of eccentric-pin shaft portions of the drive shaft and configured to eccentrically rotate in the cylinder chamber, a vane configured to separate the cylinder chamber into two spaces when a front end of the vane is pushed against an outer peripheral surface of the piston, a vane groove housing the vane in such a manner that the vane reciprocates therein and being open to the cylinder chamber, and a vane rear chamber housing a rear end of the vane and communicating with the cylinder chamber, one of the plurality of compression mechanisms being configured to switch to a compressed state in which the vane is in contact with the piston or an uncompressed state in which the vane is separated from the piston and retained, the cylinder chamber always communicating with the suction pressure space in each of the compressed state and the uncompressed state, the vane rear chamber always communicating with the discharge pressure space in each of the compressed state and the uncompressed state, each of the vanes being applied by a first force in such a direction that the vane approaches the piston caused by a pressure difference between a pressure applied to the front end of each of the vanes and a pressure applied to the rear end of each of the vanes, the plurality of compression mechanisms including a second compression mechanism part being a mechanism that includes a permanent magnet disposed in the vane rear chamber and applies a second force to the vane in such a direction that the vane moves away from the piston and switches between the compressed state and the uncompressed state depending on a magnitude correlation between the first force and the second force, the second force in switching from the compressed state to the uncompressed state being greater than an inertial force applied to the vane, the second compression mechanism part including a low-pressure introduction mechanism that introduces the low-pressure refrigerant to a space on a side of the rear end of the vane in a state in which the vane is separated from the piston.

10. A multi-cylinder rotary compressor comprising:

a drive shaft including a plurality of eccentric-pin shaft portions;

an electric motor configured to drive and rotate the drive shaft;

a plurality of compression mechanisms; and a sealed container housing the electric motor and the plurality of compression mechanisms and storing lubricating oil at a bottom thereof, each of the plurality of compression mechanisms including a cylinder having a cylinder chamber into which low-pressure refrigerant is sucked from a suction pressure space and from which compressed high-pressure refrigerant is discharged to a discharge pressure space, a ring-shaped piston slidably attached to each of the plurality of eccentric-pin shaft portions of the drive shaft and configured to eccentrically rotate in the cylinder chamber, a vane configured to separate the cylinder chamber into two spaces when a front end of the vane is pushed against an outer peripheral surface of the piston, a tension spring disposed at a rear end of the vane, a vane groove housing the vane in such a manner that the vane reciprocates therein and being open to the cylinder chamber, and a vane rear chamber housing the rear end of the vane and communicating with the cylinder chamber, one of the plurality of compression mechanisms being configured to switch to a compressed state in which the vane is in contact with the piston or an uncompressed state in which the vane is separated from the piston and retained, the cylinder chamber always communicating with the suction pressure space in each of the compressed state and the uncompressed state, the vane rear chamber always communicating with the discharge pressure space in each of the compressed state and the uncompressed state, each of the vanes being applied by a first force in such a direction that the vane approaches the piston caused by a pressure difference between a pressure applied to the front end of each of the vanes and a pressure applied to the rear end of each of the vanes, the plurality of compression mechanisms including a second compression mechanism part being a mechanism that includes a permanent magnet disposed in the vane rear chamber and applies a second force to the vane in such a direction that the vane moves away from the piston and switches between the compressed state and the uncompressed state depending on a magnitude correlation between the first force and the second force, the second force in switching from the compressed state to the uncompressed state being greater than an inertial force applied to the vane.

* * * * *